US010768541B2

(12) United States Patent
Yamada et al.

(10) Patent No.: US 10,768,541 B2
(45) Date of Patent: Sep. 8, 2020

(54) TONER FOR DEVELOPING ELECTROSTATIC IMAGES

(71) Applicant: Konica Minolta, Inc., Tokyo (JP)

(72) Inventors: Miyuki Yamada, Tama (JP); Takanari Kayamori, Kawasaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/552,399

(22) Filed: Aug. 27, 2019

(65) Prior Publication Data

US 2020/0081362 A1 Mar. 12, 2020

(30) Foreign Application Priority Data

Sep. 7, 2018 (JP) ..... 2018-167722

(51) Int. Cl.
*G03G 9/08* (2006.01)
*G03G 9/09* (2006.01)

(52) U.S. Cl.
CPC ..... *G03G 9/0918* (2013.01); *G03G 9/0819* (2013.01)

(58) Field of Classification Search
CPC ..... G03G 9/0918
See application file for complete search history.

(56) References Cited

U.S. PATENT DOCUMENTS 3,051,721 A * 8/1962 Pfeiffer ..... C09B 67/0026 540/141
3,982,938 A * 9/1976 Honjo ..... G03G 5/04 430/83
4,108,863 A * 8/1978 Komai ..... C09B 47/073 540/141
4,113,482 A * 9/1978 Wells ..... G03G 9/08 430/41
4,135,925 A * 1/1979 Wells ..... G03G 17/10 430/33
4,135,944 A * 1/1979 Wheeler ..... C09B 47/06 106/411
4,634,646 A * 1/1987 Sano ..... G03G 13/22 430/31
2002/0081508 A1* 6/2002 Horiuchi ..... C09B 67/0026 430/59.5
2003/0148201 A1* 8/2003 Kodera ..... G03G 5/0564 430/74
2010/0331460 A1* 12/2010 Ootoshi ..... B82Y 30/00 524/88

FOREIGN PATENT DOCUMENTS

JP 51108847 A * 9/1976
JP 51109841 A * 9/1976
JP 2003302792 A 10/2003
JP 2009122496 A 6/2009

OTHER PUBLICATIONS

English language machine translation of JP 51-109841. (Year: 1976).*

* cited by examiner

*Primary Examiner* — Christopher D Rodee
(74) *Attorney, Agent, or Firm* — Lucas & Mercanti, LLP

(57) ABSTRACT

A toner for developing electrostatic images includes at least a binder resin and a colorant containing a copper phthalocyanine compound, wherein in X-ray diffraction using a CuKα ray, the toner has peaks at a Bragg angle of $2\theta=7.0\pm0.1°$ and at a Bragg angle of $2\theta=9.1\pm0.2°$ and additionally has a peak between the two peaks.

3 Claims, No Drawings

TONER FOR DEVELOPING ELECTROSTATIC IMAGES

BACKGROUND

Technological Field

The present invention relates to a toner for developing electrostatic images, particularly to a toner for developing electrostatic images having high saturation while having a reduced pigment content in the toner and being excellent in coloring power as well as in low-temperature fixability.

Description of the Related Art

Electrophotographic-type image formation using a toner for developing electrostatic images (hereinbelow, also simply referred to as a toner) has been able to achieve full color printing recently, in addition to monochrome printing including conventional document preparation. Such full color image formation apparatuses can form a necessary number of prints on demand without making a plate, which is required in the case of printing, and thus, have been employed predominantly in light print fields, where small numbers of prints are frequently ordered.

On preparing full color prints for catalogs and advertisement using toners, the toners to be used are required to have color reproducibility so as to provide images faithful to the original. That is, in full color image formation, yellow, magenta, and cyan toner images are superimposed to reproduce a target color tone image. In order to achieve faithful color reproduction, it has been required for these color toners, which serves as the base, to have good color reproducibility.

Thus, various colorants for use in toners have been so far investigated for the purpose of improving the color reproducibility of color toners.

In general, as colorants for use in cyan toners, copper phthalocyanine-type pigments have been used. These copper phthalocyanine-type pigments have been excellent in color development in a low-brightness cyan region, but have provided insufficient color development in a high-brightness cyan region.

For the purpose of improving the cyan color developability in the high brightness region, various techniques have been disclosed. For example, a cyan colorant that contains a phthalocyanine compound of which central metal has a substituent is disclosed (e.g., see JP 2009-122496A).

However, the cyan colorants mentioned above have high saturation and are excellent in color development with high saturation in broad brightness regions from the low-brightness region to the high-brightness region, but the color development in the low brightness region, which has been conventionally enabled, becomes insufficient due to a large change in the hue angle. Moreover, the pigments are very expensive, and thus, resultant toners naturally become expensive. This fact has been problematic.

Alternatively, when a zinc phthalocyanine compound is used as the cyan colorant, zinc phthalocyanine, which has a green hue and low saturation, has not satisfied the color gamut in multicolor printing (e.g., see JP 2003-302792A).

SUMMARY

The present invention has been made in view of the problems and situations described above, and the problems to be solved thereof is to provide a toner for developing electrostatic images having high saturation while having a reduced pigment content in the toner and being excellent in coloring power as well as in low-temperature fixability.

The present inventors, who have conducted studies on the causes of the problems, have consequently found that a copper phthalocyanine compound needs to have peaks at a Bragg angle of $2\theta=7.0\pm0.1°$ and at a Bragg angle of $2\theta=9.1\pm0.2°$, or that a crystallite size of crystals assigned to a Bragg angle of $2\theta=7.0\pm0.1°$ needs to be within a designated range so that the hue is kept while the toner being excellent in coloring power as well as in low-temperature fixability.

Thus, the problems described above may be solved in the present invention by the following means.

To achieve at least one of the abovementioned objects, according to an aspect of the present invention, a toner for developing electrostatic images includes at least a binder resin and a colorant containing a copper phthalocyanine compound, wherein in X-ray diffraction using a CuKα ray, the toner has peaks at a Bragg angle of $2\theta=7.0\pm0.1°$ and at a Bragg angle of $2\theta=9.1\pm0.2°$ and additionally has a peak between the two peaks.

According to another aspect of the present invention, a toner for developing electrostatic images includes at least a binder resin and a colorant containing a copper phthalocyanine compound, wherein a crystallite size of crystals assigned to a Bragg angle of $2\theta=7.0\pm0.1°$ is within a range of 150 to 210 Å.

DETAILED DESCRIPTION OF EMBODIMENTS

Hereinafter, one or more embodiments of the present invention will be described. However, the scope of the invention is not limited to the disclosed embodiments.

According to the measures of the present invention described above, it is possible to provide a toner for developing electrostatic images having high saturation while having a reduced pigment content in the toner and being excellent in coloring power as well as in low-temperature fixability.

The development mechanism and the action mechanism of the effects of the present invention, although having not been revealed, are presumed to be as follows.

In the present invention, in X-ray diffraction using a CuKα ray, the toner has peaks at a Bragg angle of $2\theta=7.0\pm0.1°$ and at a Bragg angle of $2\theta=9.1\pm0.2°$ and additionally has a peak between the two peaks, and therefore it is presumed that the aspect ratio of the copper phthalocyanine compound is maintained, the hue is achieved, and additionally, a small amount of the copper phthalocyanine compound having a small aspect ratio exists. Accordingly, it is possible to obtain sufficient coloring power and to reduce the amount of the copper phthalocyanine compound added.

Meanwhile, it is presumed that the aspect ratio of the copper phthalocyanine compound is maintained also by setting the crystallite size of crystals assigned to the Bragg angle of $2\theta=7.0\pm0.1°$ within a range of 150 to 210 Å. Then, the hue is achieved and a small amount of the copper phthalocyanine compound having a small aspect ratio exists. Accordingly, it is possible to obtain sufficient coloring power and to reduce the amount of the copper phthalocyanine compound added.

The effects described above are presumed on the basis of the following background.

When a pigment originally having a large aspect ratio was used for dispersion, it was possible to obtain coloring power with a small amount of the pigment without a substantial change in the hue. Then, analysis on the XRD results of the pigment revealed that the crystallite size became smaller. A change in the aspect ratio of the pigment usually causes a change in the hue. Thus, from the fact that sufficient coloring power was obtained without influence on the hue, it is presumed that these effects were exhibited by the pigment having crystallites reduced in size. In other words, it is presumed that the particles of a small crystallite size are particles formed when pigment particles originally having a large aspect ratio were chipped into smaller particles without a substantial change in the aspect ratio. For this reason, sufficient coloring power can be obtained by the small chipped particles, and low temperature fixing has been enabled with a small amount of the pigment added.

Note that the "coloring power" in the present invention refers to the density of an image to be obtained when a predetermined amount of a toner is fixed on a recording medium. The higher the density, the larger the coloring power.

The toner for developing electrostatic images of the present invention is a toner for developing electrostatic images including at least a binder resin and a colorant containing a copper phthalocyanine compound, in X-ray diffraction using a CuKα ray, the toner having peaks at a Bragg angle of 2θ=7.0±0.1° and at a Bragg angle of 2θ=9.1±0.2° and additionally having a peak between the two peaks.

Also, the toner for developing electrostatic images of the present invention is a toner for developing electrostatic images including at least a binder resin and a colorant containing a copper phthalocyanine compound, wherein the crystallite size of crystals assigned to a Bragg angle of 2θ=7.0±0.1° is within a range of 150 to 210 Å.

These features are technical features common to or corresponding to each embodiment that follows. As an embodiment of the present invention, the value of the ratio of the number average long diameter Db to the number average short diameter Da of primary particles of the copper phthalocyanine compound (Db/Da) is preferably within a range of 3.0 to 6.0, in respect of improving the coloring power of the toner.

Also, the copper phthalocyanine compound is preferably an unsubstituted copper phthalocyanine compound, in respect of easily obtaining an image having colors in a desired color gamut (brightness and saturation).

Hereinbelow, the present invention, constituents thereof, and embodiments and aspects to carry out the present invention will be explained. In the present application, ranges indicated with "to" mean ranges including the numerical values before and after "to" as the minimum and maximum values.

[Toner for Developing Electrostatic Images]

The toner for developing electrostatic images of the present invention is a toner for developing electrostatic images that includes at least a binder resin and a colorant containing a copper phthalocyanine compound, the toner, in X-ray diffraction using a CuKα ray, having peaks at a Bragg angle of 2θ=7.0±0.1° and at a Bragg angle of 2θ=9.1±0.2° and additionally having a peak between the two peaks.

<Measurement of X-Ray Diffraction Spectrum>

(Method for Extracting Copper Phthalocyanine Compound (Cyan Pigment))

A toner is dissolved in tetrahydrofuran (THF). After the THF soluble is removed by repeating centrifugation and removal of the supernatant, the insoluble is phase-inverted into a water dispersion system. After subjected to ultrasonic dispersion, the X-ray diffraction spectrum is measured, and peaks are analyzed.

As the water dispersion system, used was an aqueous dispersion prepared by adding sodium dodecyl diphenyl ether disulfonate, as a dispersant, to the copper phthalocyanine compound in a mass ratio of 0.35 to 1 (copper phthalocyanine compound:dispersant=1:0.35). The water dispersion system was prepared such that the content of the copper phthalocyanine compound reached 12.5% by mass based on the total mass of the aqueous dispersion.

The X-ray diffraction spectrum for the toner of the present invention was measured under the following conditions, using a CuKα ray as the X-ray.

XRD Measurement

Apparatus: RINT-TTR2 manufactured by Rigaku Corporation

X-ray: Cu-Kα 50 kV-300 mA (15 kW)

Optical system: parallel beam method (transmission method)

Attachment: capillary rotating sample stage

Slit conditions: divergence slit of 0.80 mm, scattering slit open, and light receiving slit of 1.0 mm Scanning range: 2 to 45° (step width: 0.02°)

Sample preparation: a glass capillary having an inner diameter of 1 mmϕ is filled with a sample.

Here, the Bragg angle of 2θ=7.0±0.1° and the Bragg angle of 2θ=9.1±0.2° are peaks characteristic of the copper phthalocyanine compound.

In the present invention, the toner has peaks at a Bragg angle of 2θ=7.0±0.1° and at a Bragg angle of 2θ=9.1±0.2° and additionally has a peak between the two peaks.

The peak additionally present between the two peaks herein satisfies the following relational expression:

$$a/A \geq 0.15$$

wherein, according to the results of the X-ray diffraction spectrum by the XRD measurement: A: peak intensity of 2θ=7.0±0.1°; B: peak intensity of 2θ=9.1±0.2°; and a: intensity of a small peak present at 2θ=7.6±0.2°, measured between these two peaks.

Accordingly, peaks that do not satisfy the relational expression are not to be counted as peaks present between the two peaks.

That is, the peaks present between the two peaks (the peak of 2θ=7.0±0.1° and the peak of 2θ=9.1±0.2°) are considered to be derived compositionally from one copper phthalocyanine compound or raw material.

The toner of the present invention is also characterized in that the crystallite size of crystals assigned to a Bragg angle of 2θ=7.0±0.1° is within a range of 150 to 210 Å.

<Crystallite Size>

The crystallite size, which is the size of primary particles that can be considered as a single crystal constituting powder particles, is a value calculated from the width of the peak at a Bragg angle of 2θ=7.0±0.1° (integral breadth) in X-ray diffraction, based on the Scherrer equation.

When those having a crystallite size of crystals assigned to the Bragg angle of 2θ=7.0±0.1° of 210 Å or less are present, sufficient coloring power can be obtained, and the amount of the pigment added is not increased. In order to achieve a state in which those having a crystallite size of 210 Å or less are present, mixing pigments having two aspect ratios provides those having a smaller crystallite size. However, a toner is provided in which those having originally two aspect ratios are present, and thus, a hue derived from a large aspect ratio is not achieved, and moreover, the coloring power becomes inferior. Accordingly, in the present invention, the number of types of pigment before dispersion is one.

Additionally, the crystallite size of crystals assigned to the Bragg angle of 2θ=7.0±0.1° is preferably 190 Å or less on average, in respect of enabling higher coloring power to be obtained. Even when the amount of the pigment added is small, sufficient coloring power can be obtained. Thus, the elasticity of the toner is likely to decrease due to a filler effect, and the toner will be able to achieve low temperature fixing.

An example of measures to allow the crystallite size of crystals assigned to the Bragg angle of 2θ=7.0±0.1° to be within a range of 150 to 210 Å is a process in which not two copper phthalocyanine compounds compositionally different, but one copper phthalocyanine compound is used and dispersed in a bead mill having a high filling ratio.

In the toner of the present invention, the value of the ratio of the number average long diameter Db to the number average short diameter Da of primary particles of the copper phthalocyanine compound (Db/Da) is preferably within a range of 3.0 to 6.0, in respect of improving the coloring power of the toner.

<Calculation of Value of Ratio of Number Average Long Diameter Db to Number Average Short Diameter Da of Primary Particles of Copper Phthalocyanine Compound (Db/Da)>

The value of ratio of the number average long diameter Db to the number average short diameter Da (Db/Da) (hereinbelow, also referred to as the average aspect ratio) is calculated by dissolving a toner in tetrahydrofuran (THF), repeating centrifugation and removal of the supernatant to remove the THF soluble, then, dispersing the insoluble in THF, subjecting the dispersion to ultrasonic dispersion, and observing the dispersion with an electron microscope. When the binder resin of the toner is unlikely to dissolve in THF and microscope observation is difficult, or when the copper phthalocyanine compound dissolves in THF and the supernatant is colored, other solvent can be used.

Specifically, the electron microscope image is analyzed with an image analysis apparatus (LUZEX (registered trademark) manufactured by NIRECO CORPORATION). The value is calculated from the value of the ratio of the long side length to the short side length of the rectangle having the smallest area (circumscribed rectangle) among rectangles enclosing primary particles of a cyan colorant (copper phthalocyanine compound). Additionally, the long side length is taken as the long diameter of the primary particles (major axis length), and the short side length is taken as the short diameter of the primary particles. The average value of 500 or more values of the long-short ratio (aspect ratio) in total randomly extracted from 5 or more view fields is calculated, and this average value is taken as the value of the ratio of the number average long diameter Db to the number average short diameter Da (Db/Da) (average aspect ratio).

In the present invention, when the average aspect ratio is 3.0 or more, the primary particles, even if having a small primary particle size, can be present in a dispersion state in the colorant particle dispersion as a raw material and in a toner. Thus, provided is a toner which can obtain sufficient coloring power with a small content of the colorant and has high saturation. When the average aspect ratio is 6.0 or less, a toner can be provided that can suppress the hue angle from being extremely close to the blue side and achieve an image having colors in a desired color gamut (brightness and saturation).

From the viewpoint of enhancing the coloring power of the toner, the average aspect ratio of the primary particles of the copper phthalocyanine compound in the toner is preferably within a range of 3.0 to 5.0, and more preferably within a range of 3.5 to 4.5.

With respect to measures to allow the average aspect ratio to fall within a range of 3.0 to 6.0, the aspect ratio can be controlled by the type of solvent, temperature, precipitation rate, dispersion, and other conditions on crystallization in the step of producing the copper phthalocyanine compound.

The toner of the present invention contains toner base particles containing at least a binder resin and a colorant. Note that, in the present invention, toner base particles to which an external additive has been added are referred to as toner particles, and an assembly of toner particles is referred to as a toner. The toner base particles generally can be used as toner particles as they are, but in the present invention, toner base particles to which an external additive has been added are used as toner particles.

The toner base particles according to the present invention contain at least a binder resin and a colorant containing the copper phthalocyanine compound and may contain other constituents such as a release agent (wax) and a charge control agent as required.

Hereinbelow, each of components constituting the toner of the present invention will be described.

<Binder Resin>

A binder resin constituting the toner according to the present invention preferably contains an amorphous resin and a crystalline polyester resin.

(Crystalline Polyester Resin)

The crystalline polyester resin refers to a resin having not a step-wise change in the endothermic amount, but a distinct melting peak in differential scanning calorimetry (DSC), among known polyester resins obtained by a polycondensation reaction of a divalent or higher carboxylic acid (polycarboxylic acid component) and/or hydroxycarboxylic acid and a dihydric or higher alcohol (polyhydric alcohol component). The distinct melting peak specifically means a peak having a half-value width of the melting peak of 15° C. or less in the second temperature raising process, on a DSC curve obtained in the differential scanning calorimetry of the above crystalline polyester resin singly.

The melting point of the crystalline polyester resin is preferably within a range of 65 to 85° C., and more preferably within a range of 75 to 85° C. When the melting point of the crystalline polyester resin is within the above range, sufficient low-temperature fixability and excellent image preservability can be obtained. Note that the melting point of the crystalline polyester resin can be controlled by the resin composition. The melting point of the crystalline polyester resin here is the peak top temperature of the melting peak in the second temperature raising process, on a DSC curve obtained in the differential scanning calorimetry of the above crystalline polyester resin singly. Note that, in the case where a plurality of melting peaks is present on the DSC curve, the peak top temperature of the melting peak having the largest endothermic amount is taken as the melting point.

The melting point of the crystalline polyester resin (Tm), which is the peak top temperature of the endothermic peak, can be measured by DSC, using a Diamond DSC (manufactured by PerkinElmer, Inc.). Specifically, a sample is enclosed in an aluminum pan KIT No. B0143013 and placed on a sample holder of a thermal analyzer Diamond DSC (manufactured by PerkinElmer, Inc.), and the temperature is varied in the order of heating, cooling, and heating. The temperature is raised from room temperature (25° C.) in the first heating and from 0° C. in the second heating, at a temperature raising rate of 10° C./minute, to 150° C. and retained at 150° C. for 5 minutes. On cooling, the temperature is lowered from 150° C., at a temperature lowering rate of 10° C./minute, to 0° C. and retained at a temperature of 0° C. for 5 minutes. Measurement is performed by using the peak top temperature of the endothermic peak on the endothermic curve obtained during the second heating as the melting point.

The polycarboxylic acid component for forming the crystalline polyester resin is a compound containing two or more carboxy groups per molecule. Specific examples thereof include saturated aliphatic dicarboxylic acids such as succinic acid, sebacic acid, and dodecanedioic acid; alicyclic dicarboxylic acids such as cyclohexanedicarboxylic acid; aromatic dicarboxylic acids such as phthalic acid, isophthalic acid, and terephthalic acid; polycarboxylic acids of trivalent or higher such as trimellitic acid and pyromellitic acid; and anhydrides or alkyl esters having 1 to 3 carbon atoms of these carboxylic acid compounds. As the polycarboxylic acid component for forming the crystalline polyester resin, an saturated aliphatic dicarboxylic acid is preferably used. One of these may be used singly, or two or more of these may be used in combination.

The polyhydric alcohol component for forming the crystalline polyester resin is a compound having two or more hydroxy groups per molecule. Specific examples thereof include aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; polyhydric alcohols of trihydric or higher such as glycerin, pentaerythritol, trimethylolpropane, and sorbitol. As the polyhydric alcohol component for forming the crystalline polyester resin, an aliphatic diol is preferably used. One of these may be used singly, or two or more of these may be used in combination.

A method for producing the crystalline polyester resin is not particularly limited. The crystalline polyester resin can be produced by a general polymerization method of polyester, in which the above-described polycarboxylic acid and polyhydric alcohol are allowed to react in the presence of a catalyst. For example, the resin is preferably produced by suitably selecting a direct polycondensation method or a transesterification method according to the type of the monomers.

A linear aliphatic hydroxycarboxylic acid may be used in combination with the polycarboxylic acid and/or the polyhydric alcohol. Examples of the linear aliphatic hydroxycarboxylic acid for forming the crystalline polyester resin include 5-hydroxypentanoic acid, 6-hydroxyhexanoic acid, 7-hydroxypentanoic acid, 8-hydroxyoctanoic acid, 9-hydroxynonanoic acid, 10-hydroxydecanoic acid, 12-hydroxydodecanoic acid, 14-hydroxytetradecanoic acid, 16-hydroxyhexadecanoic acid, 18-hydroxyoctadecanoic acid, and lactones produced by cyclization of these hydroxycarboxylic acids, or alkyl esters of such a hydroxycarboxylic acid with an alcohol having 1 to 3 carbon atoms. One of these may be used singly, or two or more of these may be used in combination.

On forming the crystalline polyester resin, use of polycarboxylic acid and polyhydric alcohol components is preferable because the reaction can be easily controlled and a resin having an intended molecular weight can be obtained.

Examples of the catalyst that can be used for producing the crystalline polyester resin include titanium catalysts such as titanium tetraethoxide, titanium tetrapropoxide, titanium tetraisopropoxide, and titanium tetrabutoxide, and tin catalysts such as dibutyltin dichloride, dibutyltin oxide, and diphenyltin oxide.

Regarding the ratio of the polycarboxylic acid component and the polyhydric alcohol component to be used, the equivalence ratio [OH]/[COOH] of the hydroxyl groups [OH] of the polyhydric alcohol component to the carboxyl groups [COOH] of the polycarboxylic acid component is preferably 1.5/1 to 1/1.5, and more preferably from 1.2/1 to 1/1.2.

The acid value of the crystalline polyester resin is preferably within a range of 5 to 30 mgKOH/g, more preferably within a range of 10 to 25 mgKOH/g, and still more preferably within a range of 15 to 25 mgKOH/g. This acid value is the mass of potassium hydroxide (KOH) required for neutralizing the acid contained in 1 g of a sample, expressed in mg. The acid value of the resin is measured in accordance with the following procedure in compliance with JIS K0070-1992.

(Preparation of Reagent)

One gram of phenolphthalein is dissolved in 90 mL of ethyl alcohol (95% by volume) and ion exchanged water is added up to 100 mL to prepare a phenolphthalein solution. Seven grams of JIS special grade potassium hydroxide is dissolved in 5 mL of ion exchanged water, and ethyl alcohol (95% by volume) was added up to 1 liter. The solution is placed in an alkali-resistant vessel so as not to be in contact with carbon dioxide gas, and left for three days. Then, the solution is filtered to prepare a potassium hydroxide solution. Standardization follows the description of JIS K0070-1992.

(Main Test)

Into a 200 mL Erlenmeyer flask, 2.0 g of a pulverized sample is precisely weighed, 100 mL of a mixed solution of toluene/ethanol (volume ratio of toluene:ethanol=2:1) is added thereto. The sample is allowed to dissolve over five hours. Subsequently, a several drops of the phenolphthalein solution prepared is added as an indicator thereto, and titration is performed by using the prepared potassium hydroxide solution. Note that the end point of the titration is made at the point at which the pale red color of the indicator remains for about 30 seconds.

(Blank Test)

The operation same as that in the above main test is performed except that no sample is used (i.e., only the mixed solution of toluene/ethanol (volume ratio of toluene:ethanol=2:1) is used).

An acid value is calculated by substituting the titration results of the main test and blank test in the following equation (1).

$$A=[(C-B)\times f\times 5.6]/S \qquad \text{Equation (1)}$$

A: Acid value (mgKOH/g)

B: Amount of the potassium hydroxide solution added in the blank test (mL)

C: Amount of the potassium hydroxide solution added in the main test (mL)

f: Factor of 0.1 mol/L potassium hydroxide ethanol solution

S: Mass of the sample (g)

With respect to the molecular weight of the crystalline polyester resin, the weight average molecular weight (Mw) is preferably within a range of 5000 to 50000, and the number average molecular weight (Mn) is preferably within a range of 1500 to 25000, the molecular weights being calculated from the molecular weight distribution measured by gel permeation chromatography (GPC).

The measurement of the molecular weights by GCP is performed as follows.

That is, an apparatus "HLC-8320" (manufactured by TOSOH CORPORATION) and columns "TSKgel guardcolumn Super HZ-L" and "TSKgel Super HZM-M" (manufactured by TOSOH CORPORATION) are used, and tetrahydrofuran (THF) as a carrier solvent is allowed to flow at a flow rate of 0.2 ml/min while the column temperature is retained at 40° C. The measurement sample (crystalline polyester resin) is dissolved in tetrahydrofuran in a concentration of 1 mg/ml under a dissolution condition of performing the treatment using an ultrasonic disperser for five minutes at room temperature, and then, the solution is treated with a membrane filter having a pore size of 0.2 μm to obtain a sample solution. Into the apparatus, 10 μL of this sample solution is injected together with the carrier solvent described above, and detected by a refractive index detector (RI detector). The molecular weight distribution possessed by the measurement sample is calculated using a calibration curve obtained by measurement by use of monodisperse polystyrene standard particles.

As the standard polystyrene samples for measurement for the calibration curve, samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, manufactured by Pressure Chemical Co., are used, and at least 10 standard polystyrene samples are measured to form the calibration curve.

The content ratio of the crystalline polyester resin in the binder resin is preferably within a range of 5 to 20% by mass, and more preferably within a range of 5 to 10% by mass. When the content ratio of the crystalline polyester resin in the binder resin is 5% by mass or more, sufficient low-temperature fixability can be certainly obtained. Additionally, when the content ratio of the crystalline polyester resin in the binder resin is 20% by mass or less, the crystalline polyester resin can be certainly introduced into the toner on producing the toner.

As the crystalline polyester resin, a styrene-acrylic modified crystalline polyester resin, obtained by bonding a styrene-acrylic polymerization segment and a crystalline polyester polymerization segment, may be used.

The "styrene-acrylic modified crystalline polyester resin" herein is a resin constituted by polyester molecules having a block copolymer structure, which resin is obtained by chemically bonding a styrene-acrylic copolymer molecular chain (styrene-acrylic polymerization segment) to a crystalline polyester molecular chain (crystalline polyester polymerization segment).

A method for forming the crystalline polyester polymerization segment is not particularly limited. Specific types of the polycarboxylic acid and the polyhydric alcohol to be used for formation of the polymerization segment and polycondensation conditions for monomers thereof are as described above and thus will not be described here.

Meanwhile, a styrene-acrylic polymerization segment constituting the styrene-acrylic modified crystalline polyester resin is formed by addition polymerizing at least a styrene monomer and a (meth)acrylate monomer. The styrene monomer and (meth)acrylate monomer to be used are not particularly limited. For example, one or two or more selected from the following may be used.

(1) Styrene Monomer

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-docecylstyrene, derivatives thereof, and the like;

(2) (Meth)acrylate Monomer

Methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethylhexyl (meth)acrylate, n-stearyl (meth)acrylate, dodecyl (meth)acrylate, phenyl (meth)acrylate, diethylaminoethyl (meth)acrylate, dimethylaminoethyl (meth)acrylate, derivatives thereof, and the like.

Note that "(meth)acrylic acid" herein includes both acrylic acid and methacrylic acid.

The styrene-acrylic polymerization segment may be formed by using the following monomers, in addition to the monomers described above.

(3) Vinyl Esters

Vinyl propionate, vinyl acetate, vinyl benzoate, and the like;

(4) Vinyl Ethers

Vinylmethylether, vinylethylether, and the like;

(5) Vinyl Ketones

Vinylmethylketone, vinylethylketone, vinylhexylketone, and the like;

(6) N-Vinyl Compounds

N-vinylcarbazole, N-vinylindole, N-vinylpyrrolidone, and the like;

(7) Other Monomers

Vinyl compounds such as vinylnaphthalene and vinylpyridine; acrylic acid or methacrylic acid derivatives such as acrylonitrile, methacrylonitrile, and acrylamide, and the like.

A method for forming a styrene-acrylic polymerization segment is not particularly limited, and an example thereof is a method of performing polymerization by a known polymerization technique such as bulk polymerization, solution polymerization, an emulsion polymerization method, a mini-emulsion method, and a dispersion polymerization method, using any polymerization initiator, such as a peroxide, a persulfide, a persulfate, and an azo compound, which are usually used for the polymerization of the monomers described above.

The content ratio of the crystalline polyester polymerization segment in the styrene-acrylic modified crystalline polyester resin is not particularly limited, but is preferably within a range of 60 to 99% by mass, and more preferably within a range of 70 to 98% by mass, based on 100% by mass of the styrene-acrylic modified polyester resin.

The content ratio of the styrene-acrylic polymerization segment in the styrene-acrylic modified crystalline polyester resin (hereinbelow, also referred to as a "styrene-acrylic modification amount") is not particularly limited, but is preferably within a range of 1 to 40% by mass, and more preferably within a range of 2 to 30% by mass, based on 100% by mass of the styrene-acrylic modified crystalline polyester resin.

The styrene-acrylic modification amount specifically refers to the proportion of the total mass of a styrene monomer and a (meth)acrylate monomer, based on the total mass of resin materials to be used for synthesizing the styrene-acrylic modified crystalline polyester resin, that is, the total mass of a monomer for synthesizing an unmodified crystalline polyester resin, which is to be a crystalline polyester polymerization segment, the styrene monomer and (meth)acrylate monomer, which are to be a styrene-acrylic polymerization segment, and a bireactive monomer for bonding these monomers.

The "bireactive monomer" herein is a monomer that bonds the styrene-acrylic polymerization segment and crystalline polyester polymerization segment. The bireactive monomer has both a group forming the crystalline polyester polymerization segment, selected from a hydroxy group, carboxy group, epoxy group, primary amino group, and secondary amino group, and an ethylenic unsaturated group forming the styrene-acrylic polymerization segment in the molecule thereof.

Examples of the bireactive monomer include acrylic acid, methacrylic acid, fumaric acid, and maleic acid, and the bireactive monomer further may be a hydroxyalkyl ester thereof (1 to 3 carbon atoms). From the viewpoint of reactivity, acrylic acid, methacrylic acid, or fumaric acid is preferable. The styrene-acrylic polymerization segment and the crystalline polyester polymerization segment are bonded via this bireactive monomer.

The amount of the bireactive monomer to be used is preferably within a range of 1 to 20% by mass based on the total amount of the monomers constituting the styrene-acrylic polymerization segment, taken as 100% by mass, from the viewpoint of improving the low-temperature fixability.

A method for producing the styrene-acrylic modified crystalline polyester resin is not particularly limited, as long as the method can form a polymer having a structure formed by chemically bonding the crystalline polyester polymerization segment and the styrene-acrylic polymerization segment. Specific examples of the method for producing the styrene-acrylic modified crystalline polyester resin includes methods shown below.

(A) A method of forming a styrene-acrylic polymerization segment by polymerizing a crystalline polyester polymerization segment in advance, reacting the crystalline polyester polymerization segment with a bireactive monomer, and further with a styrene monomer and a (meth)acrylate monomer for forming the styrene-acrylic polymerization segment;

(B) A method of forming a crystalline polyester polymerization segment, by polymerizing a styrene-acrylic polymerization segment in advance, reacting the styrene-acrylic polymerization segment with a bireactive monomer, and further with a polycarboxylic acid and a polyhydric alcohol for forming the crystalline polyester polymerization segment; and (C) A method of bonding the crystalline polyester polymerization segment and the styrene-acrylic polymerization segment, which are each polymerized in advance, by reacting them with a bireactive monomer.

Among the above forming methods (A) to (C), the method (A) is preferable from the viewpoint of being capable of simplifying the production process.

<Amorphous Resin>

In the present invention, as amorphous resins, an amorphous polyester resin and amorphous vinyl resin can be employed.

An amorphous resin is a resin in which no distinct endothermic peak is observed by differential scanning calorimetry (DSC). That is, the resin usually has no melting point (distinct endothermic peak on a DSC curve measured using a differential scanning calorimetry (DSC) apparatus), and has a relatively high glass transition temperature (Tg). More specifically, the Tg of the amorphous resin obtained by the differential scanning calorimetry apparatus is preferably within a range of 35 to 70° C., and more preferably within a range of 50 to 65° C. When the amorphous resin has a Tg of 35° C. or more, it is possible to provide the toner with sufficient thermal strength and to obtain a sufficient heat-resistant storage property. When the amorphous resin has a Tg of 70° C. or less, sufficient low-temperature fixability can be certainly obtained.

The Tg of the amorphous resin is measured in accordance with the method (DSC method) specified in ASTM (American Society for Testing and Materials standard) D3418-82. That is, 4.5 mg of a measurement sample (amorphous resin) is precisely weighed to two decimal places, enclosed in an aluminum pan, and placed on a sample holder of a differential scanning calorimeter "DSC8500" (manufactured by PerkinElmer, Inc.). As a reference, an empty aluminum pan is used, and temperature control of temperature raising—temperature lowering—temperature raising is performed at a measurement temperature of −10 to 120° C., at a temperature raising rate of 10° C./minute and a temperature lowering rate of 10° C./minute. Analysis is performed based on the data obtained during the second temperature raising. The value of the intersection of a line extended from the base line before the first endothermic peak rises up and a tangent line which represents the maximum slope of the first endothermic peak within the range from the rise-up point to the apex of the peak is taken as the glass transition temperature.

With respect to the molecular weight of the amorphous resin determined by gel permeation chromatography (GPC), it is preferable that the number average molecular weight (Mn) be within a range of 1500 to 25000 and the weight average molecular weight (Mw) be within a range of 10000 to 80000. When the molecular weight of the amorphous resin is within the above range, both sufficient low-temperature fixability and excellent heat-resistant storage property can be certainly obtained. The molecular weight measurement of the amorphous resin by GPC is performed in the same manner as described above except that the amorphous resin is used as the measurement sample.

(Amorphous Polyester Resin)

An amorphous polyester resin is a polyester resin other than crystalline polyester resins.

The acid value of the amorphous polyester resin is preferably within a range of 5 to 45 mgKOH/g, and more preferably within a range of 5 to 30 mgKOH/g. An acid value of 45 mgKOH/g or less would be preferable in that the hygroscopicity does not increase and a decrease in the chargeability can be prevented even under a high humidity. Also, an acid value of 5 mgKOH/g or more would be preferable in that the dispersion stability of resin particles can be retained and a toner is easily produced. Note that the acid value can be obtained in the same manner as the method described in the description of the crystalline polyester resin.

The amorphous polyester resin may be one amorphous polyester resin or may be a mixture of two or more amorphous polyester resins.

As the amorphous polyester resin, a known polyester resin can be used. The amorphous polyester resin is synthesized from a polycarboxylic acid component and a polyhydric alcohol component. Note that, as the amorphous polyester resin, a commercially available product may be used or a synthesized product may be used.

Examples of the polyhydric alcohol component that can be used include diols such as ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexanedimethanol, dipropylene glycol, polyethylene glycol, polypropylene glycol, bisphenol A, hydrogenated bisphenol A, BPA-PO (adduct of bisphenol A with n mol of propylene oxide), and BPA-EO (adduct of bisphenol A with n mol of ethylene oxide). Additionally, for example, trihydric or higher polyhydric alcohols, such as glycerin, sorbitol, 1,4-sorbitan, and trimethylolpropane can be used. Among these, bisphenol A, hydrogenated bisphenol A, BPA-PO, or BPA-EO is preferable, BPA-PO or BPA-EO is more preferable, and an adduct of bisphenol A with 2 mol of propylene oxide or an adduct of bisphenol A with 2 mol of ethylene oxide is still more preferable. One of these may be used singly, or two or more of these may be used in combination.

Examples of the polycarboxylic acid component include aromatic dicarboxylic acids such as terephthalic acid, isophthalic acid, phthalic acid, and naphthalene dicarboxylic acid; aliphatic saturated dicarboxylic acid such as succinic acid, alkenyl succinic acid, adipic acid, suberic acid, azelaic acid, sebacic acid, 1,9-nonanedicalboxylic acid, 1,10-decanedicarboxylic acid, 1,12-dodecanedicarboxylic acid, 1,14-tetradecanedicarboxylic acid, and 1,18-octadecanedicarboxylic acid; aliphatic unsaturated dicarboxylic acids such as maleic acid, maleic acid, fumaric acid, itaconic acid, itaconic anhydride, citraconic acid, citraconic acid, and mesaconic acid; alicyclic polyvalent carboxylic acids such as cyclohexanedicarboxylic acid; and salts, lower alkyl esters, and acid anhydrides thereof. Among these, aromatic dicarboxylic acids, and salts, lower alkyl esters, and acid anhydrides thereof are preferable, and terephthalic acid, phthalic acid, and salts, lower alkyl esters, and acid anhydrides thereof are more preferable. One of these polycarboxylic acid components may be used singly, or two or more of these may be used in combination.

When a polycarboxylic acid of trivalent or higher is contained as the polycarboxylic acid component, a polymer chain can have a crosslinked structure. Having the crosslinked structure can also provide an effect of fixing the crystalline polyester resin which has been once dissolved mutually with the amorphous polyester resin and of making the separation of the resins difficult.

Examples of the carboxylic acid of trivalent or higher include trimellitic acid such as 1,2,4-benzenetricarboxylic acid and 1,2,5-benzenetricalboxylic acid, 1,2,4-naphthalenetricarboxylic acid, hemimellitic acid, trimesic acid, mellophanic acid, prehnitic acid, pyromellitic acid, mellitic acid, 1,2,3,4-butanetetracarboxylic acid, and salts, lower alkyl esters, and acid anhydrides thereof. Among these, trimellitic acid or a salt, lower alkyl ester, or acid anhydride thereof are particularly suitable.

When a dicarboxylic acid and a carboxylic acid of trivalent or higher are contained as the polycarboxylic acid component, an amount of the carboxylic acid of trivalent or higher added is preferably within a range of 1 to 30% by mol, more preferably within a range of 5 to 20% by mol, and preferably within a range of 10 to 15% by mol, based on the total number of moles of the polycarboxylic acid component.

Alternatively, as the polycarboxylic acid component, a dicarboxylic acid component having a sulfonic acid group may be contained, in addition to the compounds mentioned above.

The production of the amorphous polyester resin is not particularly limited, but is performed by a polycondensation reaction of the polycarboxylic acid component and the polyhydric alcohol component at a polymerization temperature of 180 to 260° C. The reaction is preferably performed while the pressure of the reaction system is reduced and water or alcohol, which is generated during condensation, is removed, as required. The polymerization time is not particularly limited, but is preferably 1 to 10 hours, and more preferably 2 to 6 hours.

When the polymerizable monomer (polycarboxylic acid component or polyhydric alcohol component) is not soluble or not compatible at the reaction temperature, the monomer may be dissolved by adding a solvent having a high-boiling point as a solubilizing agent. A polycondensation reaction is performed while the solubilizing agent is distilled out. When a polymerizable monomer having poor compatibility is present in the copolymerization reaction, the polymerizable monomer having poor compatibility may be condensed in advance with an acid or alcohol to be polycondensed with this monomer, followed by polycondensation with the main component.

Examples of a catalyst that can be used on producing the amorphous polyester resin include alkali metal compounds including sodium and lithium; group 2 metal compounds including magnesium and calcium; metal compounds including zinc, manganese, antimony, titanium, tin, zirconium, and germanium; phosphorous acid compounds; phosphoric acid compounds; and amine compounds. One of these may be used singly, or two or more of these may be used in combination. Among these, from the viewpoint of making Mw/Mn smaller, the catalyst is preferably a metal compound including zinc, manganese, antimony, titanium, tin, zirconium, germanium, and the like, and more preferably a metal compound of tin (tin catalyst). Examples of the tin catalyst include, but are not particularly limited to, dibutyltin oxide.

The amount of the catalyst added is not particularly limited, but is preferably in a range of 0.00001 to 10% by mass based on the total amount of the polycarboxylic acid. A larger amount of the catalyst added enables the reaction to proceed more certainly, and a smaller amount of the catalyst added is excellent in economic efficiency.

The content of the amorphous polyester resin is preferably 5 to 30% by mass, and more preferably 5 to 20% by mass, based on the entire binder resin. When the content is within such a range, a toner to be obtained is excellent in blocking resistance, and low-temperature fixability can be also obtained.

(Amorphous Vinyl Resin)

The amorphous vinyl resin is not particularly limited as long as the resin is a polymer of a vinyl compound, and examples thereof include acrylate resins, styrene-(meth) acrylate resins, and ethylene-vinyl acetate resins. One of these may be used singly, or two or more of these may be used in combination.

Among the amorphous vinyl resins described above, in consideration of the plasticity on thermal fixing, a styrene-(meth)acrylate resin (hereinbelow, also referred to as a "styrene-acrylic resin") is preferable. Accordingly, the styrene-acrylic resin as the amorphous vinyl resin will be described hereinbelow.

The styrene-acrylic resin is a resin formed by addition polymerizing at least a styrene monomer and a (meth) acrylate monomer. The styrene monomer referred to herein includes those of a structure having a known side chain or functional group in the styrene structure, in addition to styrene represented by the structural formula: $CH_2{=}CH{-}C_6H_5$. The (meth)acrylate monomer referred to herein includes esters having a known side chain or functional group in the structure such as an acrylate derivative, methacrylate derivative or the like, in addition to acrylates or methacrylates represented by $CH_2{=}CHCOOR$ (R is an alkyl group).

Specific examples of the styrene monomer and (meth) acrylate monomer that enable a styrene-acrylic resin to be formed are shown hereinbelow, but the monomers to be used in the present invention are not limited to the following.

Specific examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. One of these styrene monomers can be used singly or two or more of these can be used in combination.

Specific examples of the (meth)acrylate monomer include acrylate monomers such as methyl acrylate, ethyl acrylate, isopropyl acrylate, n-butyl acrylate, tert-butyl acrylate, isobutyl acrylate, n-octyl acrylate, 2-ethylhexyl acrylate, stearyl acrylate, lauryl acrylate, and phenyl acrylate; and methacrylate monomers such as methyl methacrylate, ethyl methacrylate, n-butyl methacrylate, isopropyl methacrylate, isobutyl methacrylate, tert-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate. One of these acrylate monomers or methacrylate monomers can be used singly or two or more of these can be used in combination. That is, any of formation of a copolymer using a styrene monomer and two or more acrylate monomers, formation of a copolymer using a styrene monomer and two or more methacrylate monomers, or formation of a copolymer using a styrene monomer, an acrylate monomer, and a methacrylate monomer can be achieved.

The content of a constituent unit derived from the styrene monomer in the styrene-acrylic resin is preferably within a range of 60 to 85% by mass based on the total amount of the styrene-acrylic resin. Additionally, the content of a constituent unit derived from the (meth)acrylate monomer in the styrene-acrylic resin is preferably within a range of 15 to 40% by mass based on the total amount of the styrene-acrylic resin.

Further, to the styrene-acrylic resin, for example, a carboxyl group-containing compound such as acrylic acid, methacrylic acid, maleic acid, itaconic acid, cinnamic acid, fumaric acid, monoalkyl maleate, and monoalkyl itaconate; a hydroxy group-containing compound such as 2-hydroxyethyl (meth)acrylate, 2-hydroxypropyl (meth)acrylate, 3-hydroxypropyl (meth)acrylate, 2-hydroxybutyl(meth)acrylate, 3-hydroxybutyl(meth)acrylate, 4-hydroxybutyl(meth)acrylate, and polyethylene glycol mono(meth)acrylate may be addition polymerized, in addition to the styrene monomer and (meth)acrylate monomer described above.

The content of the constituent unit derived from the compound in the styrene-acrylic resin is preferably within a range of 0.1 to 15% by mass based on the total amount of the styrene-acrylic resin.

The content of the amorphous vinyl resin is preferably within a range of 40 to 95% by mass, and more preferably within a range of 60 to 90% by mass, based on the entire binder resin. When the content is within such a range, flexibility in resin design is high and chargeability control is easy for a toner to be obtained.

<Colorant>

The colorant according to the present invention contains a copper phthalocyanine compound. As mentioned above, in X-ray diffraction on the copper phthalocyanine compound in the toner using a CuKα ray, the toner has peaks at a Bragg angle of $2\theta=7.0\pm0.1°$ and at a Bragg angle of $2\theta=9.1\pm0.2°$ and additionally has a peak between the two peaks. Alternatively, in X-ray diffraction on the copper phthalocyanine compound in the toner using a CuKα ray, the crystallite size of crystals assigned to a Bragg angle of $2\theta=7.0\pm0.1°$ is within a range of 150 to 210 Å.

As the copper phthalocyanine compound in the present invention, an existing copper phthalocyanine compound may be used, but an unsubstituted copper phthalocyanine compound is preferable in respect of easily obtaining an image having colors in a desired color gamut (brightness and saturation).

The copper phthalocyanine compound may contain only an unsubstituted copper phthalocyanine compound, may contain only a substituted copper phthalocyanine compound, or may contain both an unsubstituted copper phthalocyanine compound and a substituted copper phthalocyanine compound.

In the case where the copper phthalocyanine compound simultaneously contains an unsubstituted copper phthalocyanine compound and a substituted copper phthalocyanine compound, the substituted copper phthalocyanine compound forms a portion that disturbs the crystal structure of the copper phthalocyanine compound. Then, on producing primary particles of the colorant (copper phthalocyanine compound) by solvent salt milling described below or the like, reduction in the primary particle size and control of the particle size distribution are facilitated to thereby enable coloring power, color reproducibility, and the like to be more easily controlled. Thus, this case is preferable.

This case is also excellent in that, when the substituted copper phthalocyanine compound is contained, the compatibility of the colorant with the binder resin is improved by the substituent (functional group) of the substituted copper phthalocyanine compound and the colorant is more likely to be incorporated into the binder resin (the dispersibility of the cyan pigment (colorant) into the entire toner is improved).

Herein, "unsubstituted" means that hydrogen atoms on the copper phthalocyanine skeleton are not substituted by substituents. "Substituted" means that hydrogen atoms on the copper phthalocyanine skeleton are substituted by substituents.

The unsubstituted copper phthalocyanine compound has crystal types such as an α type, a β type, and an ε type. In the present invention, the β type is preferable in respect of the hue, color developability, stability, and dispersibility. Specifically examples include C.I. Pigment Blue 15:3 and C.I. Pigment Blue 15:4 as the β type, C.I. Pigment Blue 15, C.I. Pigment Blue 15:1, and C.I. Pigment Blue 15:2 as the α type, and C.I. Pigment Blue 15:6 as the ε type.

The substituted copper phthalocyanine compound preferably has a structure represented by the following general formula (I) or (II).

$$P\text{-}(Y)_m \quad (I)$$

$$P\text{-}(A\text{-}Z)_n \quad (II)$$

[wherein P represents a residue left after n hydrogen atoms are removed from the copper phthalocyanine ring; Y represents a primary to tertiary amino group, carboxy group, sulfonic acid group, or a basic or metal salt thereof; A represents a divalent linking group; Z represents a residue left after at least one of hydrogen atoms on the nitrogen atom of a primary to secondary amine group is removed, or a residue left after at least one of hydrogen atoms on the nitrogen atom of a nitrogen-containing heterocycle is removed; m represents an integer of 1 to 4, and n represents an integer of 1 to 4.]

Examples of the secondary to tertiary amino groups include monomethylamino groups, dimethylamino groups, and diethylamino groups. Examples of the base or metal that forms a salt with the carboxy group or the sulfonic acid group include organic bases such as ammonia, dimethylamine, diethylamine, and triethylamine, and metals such as potassium, sodium, calcium, strontium, and aluminum. Examples of the divalent linking group as A include alkylene groups having 1 to 3 carbon atoms, —$CO_2$—, —$SO_2$—, and —$SO_2NH(CH_2)_m$—, and examples of Z include a phthalimide group, monoalkylamino group, and dialkylamino group.

Among these, the substituted copper phthalocyanine compound, which has been substituted by a basic substituent (amino group or the like), is preferable because interaction among the basic substituent and the acid group and the ester group of the crystalline polyester resin occurs to thereby also improve controllability of the chargeability.

The number average long diameter of the primary particles of the copper phthalocyanine compound in the toner is preferably within a range of 70 to 220 nm, more preferably within a range of 80 to 200 nm, and particularly preferably within a range of 130 to 170 nm.

When the number average long diameter of the primary particles of the copper phthalocyanine compound in the toner is 70 nm or more, aggregation of the colorant particles can be more certainly suppressed on producing the toner, the coloring power is enhanced, and the lightfastness is also improved. Thus, the number average long diameter of 70 nm or more is preferable. When the average long diameter is 220 nm or less, the hue angle can be suppressed from being extremely close to the blue side, and the contact area between the colorant particles and the binder resin is extended. Then, in the case where a crystalline polyester resin is used as the binder resin, control of the chargeability, which is considered to occur due to a change in the domain structure of the crystalline polyester resin, can be certainly performed. Thus, the average long diameter of 220 nm or less is preferable.

The content of the copper phthalocyanine compound in the toner is preferably within in a range of 1.0 to 4.0% by mass, more preferably within a range of 2.0 to 3.8% by mass, and particularly preferably less than 3.6% by mass. Preferably within a range of % by mass When the content of the copper phthalocyanine compound in the toner is within a range of 1.0 to 4.0% by mass, the coloring power is not impaired even with a small amount while the content is reduced. With a small amount as described above, the original properties of the resin in the toner can be utilized. Even when the same resin structure is employed, use of the copper phthalocyanine compound can achieve low temperature fixing.

Herein, as a method for producing a copper phthalocyanine compound, any of known routine production methods can be employed.

(Method of Producing Copper Phthalocyanine Compound)

As the method for producing a copper phthalocyanine compound, them can be used, for example, a method of synthesizing a metal phthalocyanine by reacting phthalic anhydride, urea, and a metal salt, which method is called the Wyler method, and a method of synthesizing a metal phthalocyanine by reacting phthalonitrile and a metal salt, which method is called the phthalonitrile method.

Additionally, a method of synthesizing a metal phthalocyanine by reacting phthalic anhydride, urea, and a metal salt in the presence of trimellitic acid, pyromellitic acid, or a derivative thereof such as an anhydride, imide and ester (see JP 61-203175A) or a method of synthesizing a metal phthalocyanine by using a paraffinic hydrocarbon solvent and a naphthenic hydrocarbon solvent in combination (see JP 8-27388A) also can be used.

As another embodiment of the method for producing a copper phthalocyanine compound, a copper phthalocyanine compound is prepared by purifying a crude pigment. That is, the compound can be obtained by subjecting a crude pigment to a pigment formation treatment. This pigment formation treatment is not particularly limited, and various pigment formation treatments can be employed. In respect of enabling significant crystal growth to be suppressed and easily controlling the aspect ratio of the copper phthalocyanine compound, a solvent salt milling treatment is more preferably employed than a solvent treatment, where a crude pigment is heated and stirred in a large amount of an organic solvent.

This solvent salt milling means kneading and grinding a crude pigment, an inorganic salt, and an organic solvent. Specifically, a crude pigment, an inorganic salt, and an organic solvent that does not dissolve these are placed in a kneader, and kneaded and ground therein. As the kneader that is used in this case, for example, a kneader or mixing muller can be used.

As the inorganic salt described above, a water-soluble inorganic salt can be suitably used and, for example, an inorganic salt such as sodium chloride, potassium chloride, and sodium sulfate is preferably used. Use of an inorganic salt having an average particle size of 0.5 to 50 μm is more preferred. Such an inorganic salt can be easily obtained by finely pulverizing a common inorganic salt.

The amount of the inorganic salt used is preferably within a range of 6 to 20 parts by mass, more preferably within a range of 8 to 15 parts by mass, per 1 part by mass of the crude pigment.

For the organic solvent, a water-soluble organic solvent as an organic solvent capable of suppressing crystal growth can be suitably used. For example, diethylene glycol, glycerin, ethylene glycol, propylene glycol, liquid polyethylene glycol, liquid polypropylene glycol, 2-(methoxymethoxy)ethanol, 2-butoxyethanol, 2-(isopentyloxy)ethanol, 2-(hexyloxy)ethanol, diethylene glycol monomethyl ether, diethylene glycol monoethyl ether, diethylene glycol monobutyl ether, triethylene glycol, triethylene glycol monomethyl ether, 1-methoxy-2-propanol, 1-ethoxy-2-propanol, dipropylene glycol, dipropylene glycol monomethyl ether, dipropylene glycol monomethyl ether, dipropylene glycol, or the like can be used.

The amount of the water-soluble organic solvent used is not particularly limited, but is preferably 0.01 to 15 parts by mass per 1 part by mass of the crude pigment.

To obtain a copper phthalocyanine compound used in the present invention, only the crude pigment of the unsubstituted copper phthalocyanine compound may be subjected to solvent salt milling, or the crude pigment of the unsubstituted copper phthalocyanine compound, and the substituted copper phthalocyanine compound may be used in combination and subjected to solvent salt milling.

The copper phthalocyanine compound obtained by using the crude pigment of the unsubstituted copper phthalocyanine compound, and the substituted copper phthalocyanine compound in combination and subjecting them to solvent salt milling will be a copper phthalocyanine compound containing the unsubstituted copper phthalocyanine compound and the substituted copper phthalocyanine compound. Then, the compound containing the unsubstituted copper phthalocyanine compound and the substituted copper phthalocyanine compound, as a whole, has an average aspect ratio within the range mentioned above.

The content of the substituted copper phthalocyanine compound that can be included in the crude pigment during solvent salt milling is usually within a range of 0.01 to 0.3 parts by mass per 1 part by mass of the crude pigment. The average aspect ratio and the axis length can be controlled by adjusting the content of the substituted copper phthalocyanine compound. For example, a higher content of the substituted copper phthalocyanine compound leads to a shorter length of the major axis and a smaller average aspect ratio.

The temperature on solvent salt milling is preferably within a range of 30 to 150° C., more preferably within a range of 50 to 100° C., and particularly preferably within a range of 60 to 95° C. The time for solvent salt milling is preferably 5 to 20 hours, and more preferably 5 to 18 hours.

When conditions other than the kneading time on solvent salt milling are set constant, the aspect ratio and the axis length can be controlled by adjusting the kneading time. Specifically, a longer kneading time leads to a shorter length of the major axis and a smaller average aspect ratio.

Additionally, in the present invention, for the colorant, in addition to the copper phthalocyanine compound, various known colorants such as carbon black, black iron oxide, dyes, and pigments can be used. For example, in a Bk (black) toner, the copper phthalocyanine compound and carbon black may be used in combination.

The toner according to the present invention, in particular, is preferably used as a cyan toner that is required to control the saturation and the hue angle each within a desired range.

<Release Agent>

The toner of the present invention for developing electrostatic images may contain a release agent. As the release agent, various known waxes can be used.

Specific examples thereof include polyolefin waxes such as polyethylene wax and polypropylene wax;

branched chain hydrocarbon waxes such as microcrystalline wax; long chain hydrocarbon waxes such as paraffin wax and sasol wax; dialkyl ketone waxes such as distealyl ketone; ester waxes such as carnauba wax, montan wax, behenyl behenate, trimethylolpropane tribehenate, pentaerythritol tetrabehenate, pentaerythritol diacetate dibehenate, glycerin tribehenate, 1,18-octadecane diol distearate, tristearyl trimellitate, and distealyl maleate; and amide waxes such as ethylene diamine behenyl amide and tristearyl trimellitate amide.

As the release agent, release agents having no interaction such as compatibility with a resin constituting the binder resin are preferably used.

Among these, from the viewpoint of releasability on low temperature fixing, a release agent having a low melting point, specifically having a melting point within a range of 60 to 100° C. is preferably used. Also, as the release agent, a releasing agent having a melting point of approximately (Mp1−10)° C. to (Mp1+20)° C., where Mp1 is the melting point of the crystalline polyester resin constituting the binder resin.

The content ratio of the release agent is preferably within a range of 1 to 20% by mass, and more preferably within a range of 5 to 20% by mass, in the toner. When the content ratio of the release agent in the toner is within the above range, both releasing property and fixability can be certainly obtained.

As a method for introducing the release agent into the toner, an example is a method in which, in the aggregation and fusing step of the method for producing the toner described below, particles constituted only of the release agent along with amorphous resin particles, crystalline polyester resin particles, and the like are aggregated and fused in an aqueous medium. The release agent particles can be obtained as a dispersion in which the release agent is dispersed in the aqueous medium. Such a dispersion of the release agent particles can be prepared by heating an aqueous medium containing a surfactant at a temperature higher than the melting point of the release agent, adding a melted release agent solution, applying mechanical energy such as mechanical stirring or ultrasonic energy for fine dispersion, and thereafter cooling the dispersion.

When the amorphous resin is, for example, a styrene-acrylic resin, the release agent can also be introduced into the toner by mixing the release agent into the amorphous resin particles (styrene-acrylic resin particles) to be subjected to the aggregation and fusing step in advance.

Specifically, the release agent is dissolved in a solution of a polymerizable monomer for forming the styrene-acrylic resin. A dispersion of the amorphous resin particles containing the release agent can be prepared by adding this solution to an aqueous medium containing a surfactant, applying mechanical energy such as mechanical stirring or ultrasonic energy as described above for fine dispersion, and thereafter adding a polymerization initiator to perform polymerization at a desired polymerization temperature, that is, by a so-called miniemulsion polymerization method.

<Charge Control Agent>

As the charge control agent, various known compounds can be used.

The content ratio of the charge control agent is preferably in a range of 0.1 to 10% by mass, and more preferably in a range of 1 to 5% by mass, in the toner.

<External Additive>

An external additive is attached to the surfaces of the toner base particles for the purpose of controlling fluidity and chargeability.

As the external additive, a conventionally known metal oxide particles can be used, and examples thereof include silica particles, titanium oxide particles, alumina particles, zirconia particles, zinc oxide particles, chromium oxide particles, cerium oxide particles, antimony oxide particles, tungsten oxide particles, tin oxide particles, tellurium oxide particles, manganese oxide particles, and boron oxide particles. One of these may be used singly, or two or more of these may be used in combination.

As for the silica particles, silica particles prepared by a sol-gel method can be used. The silica particles prepared by a sol-gel method, which are characterized by having a narrow particle size distribution, are preferable in respect of suppressing variation in the adhesion strength.

The silica particles produced by a sol-gel method preferably have a number average primary particle size within a range of 70 to 150 nm. The silica particles having a number average primary particle size within such a range, which have a particle size larger than that of other external additives, serve as a spacer. The silica particles have an effect of preventing the other external additives having a smaller particle size from being embedded in the toner base particles due to stirring and mixing in a developing machine and have an effect of preventing the toner base particles from being fused to one another.

In addition, organic particles of a homopolymer of styrene, methyl methacrylate or the like, a copolymer thereof, and the like may be used as an external additive.

The metal oxide particles used as an external additive are preferably metal oxide particles, the surfaces of which have been hydrophobized with a known surface treatment agent such as a coupling agent. As the surface treatment agent described above, dimethyldimethoxysilane, hexamethyldisilazane (HMDS), methyltrimethoxysilane, isobutyltrimethoxysilane, decyltrimethoxysilane, or the like is preferable.

Further, as the surface treatment agent, a silicone oil can also be used. Specific examples of the silicone oil include a cyclic compound such as an organosiloxane oligomer, octamethylcyclotetrasiloxane, or decamethylcyclopentasiloxane, tetramethylcyclotetrasiloxane, and tetravinyltetramethylcyclotetrasiloxane, and a straight or branched organosiloxane. In addition, a silicone oil that is highly reactive and has at least a modified end, in which a modifying group is introduced into a side chain, one end, both ends, one side chain end, both side chain ends, or the like, may be used. Examples of the modifying group include, but are not particularly limited to, an alkoxy group, a carboxy group, a carbinol group, modification with a higher fatty acid, a phenol group, an epoxy group, a methacrylic group, and an amino group. Further, for example, a silicone oil having several types of modifying groups of amino/alkoxy modification may also be accepted.

Further, a mixing treatment or combination treatment may be performed using a dimethyl silicone oil and the modified silicone oil described above, as well as other surface treatment agents. Examples of the treatment agents to be used in combination can include silane coupling agents, titanate coupling agents, aluminate coupling agents, various silicone oils, fatty acids, fatty acid metal salts, esterification products thereof, and rosin acid.

In order to further improve cleaning performance and transferability, a lubricant can be used as an external additive. Examples of the lubricant include metal salts of higher fatty acid, such as a salt of zinc, aluminum, copper, magnesium, calcium, or the like of stearic acid, a salt of zinc, manganese, iron, copper, magnesium, or the like of oleic acid, a salt of zinc, copper, magnesium, calcium, or the like of palmitic acid, a salt of zinc, calcium, or the like of linoleic acid, and a salt of zinc, calcium, or the like of ricinoleic acid.

The total amount of these external additives added is preferably within a range of 0.1 to 10% by mass, and more preferably within a range of 1 to 5% by mass, per 100 parts by mass of the toner base particles.

The toner of the present invention preferably has a core-shell structure, which includes core particles containing a binder resin and a colorant and a shell layer with which the surface of the core particles is coated. Note that the shell layer is not limited to shell layers with which the core particles are completely coated and a portion of the surface of the core particles may be exposed. When the toner has the core-shell structure, charge stability and heat-resistant storage properties can be obtained. A resin constituting the shell layer is not particularly limited, but an amorphous polyester resin or amorphous vinyl resin is preferably used.

The core-shell structure can be confirmed by observing the structure of a cross section of the toner using known measures, for example, a transmission electron microscope (TEM), scanning probe microscope (SPM), or the like.

<Average Particle Size of Toner>

In the toner of the present invention, with respect to each toner particle constituting this toner, the average particle size is, for example, preferably within a range of 3 to 8 μm, and more preferably within a range of 5 to 8 μm in a volume-based median diameter.

In the case of production by employing an emulsion aggregation method described below, for example, this average particle size can be controlled by the concentration of a coagulant to be used, the amount of an organic solvent added, fusing time, the composition of the polymer, and the like. When the volume-based median diameter is within the above range, the transfer efficiency is enhanced, leading to enhanced halftone image quality and enhanced fine-line and dot quality.

The volume-based median diameter of the toner is measured and calculated using a measuring apparatus including a "MULTISIZER 3" (manufactured by Beckman Coulter, Inc.) and a computer system connected thereto and installed with data processing software "Software V3.51".

Specifically, 0.02 g of a measurement sample (toner) is added to 20 mL of a surfactant solution (a surfactant solution obtained by diluting, for example, a neutral detergent containing a surfactant component ten-fold with pure water, for the purpose of dispersing the toner) and is mixed well therewith. Then, ultrasonic dispersion is performed for 1 minute to prepare a toner dispersion. This toner dispersion is added with a pipette to a beaker held in a sample stand and containing "ISOTON II" (manufactured by Beckman Coulter, Inc.) until the concentration displayed on the measuring apparatus reaches 8%. Here, a reproducible measurement value can be obtained by reaching the above concentration range. Then, in the measuring apparatus, the number of particles to be counted is set to 25,000, and the diameter of an aperture is set to 100 μm. A range of 2 to 60 μm, which is the measurement range, is divided into 256 sections, and a frequency value in each section is calculated. The particle size when a cumulative volume fraction cumulated from the largest volume fraction is 50% is taken as the volume-based median diameter.

<Average Circularity of Toner>

In the toner of the present invention, with respect to the individual toner particle constituting this toner, the average circularity is preferably within a range of 0.930 to 1.000, and more preferably within a range of 0.950 to 0.995, from the viewpoint of the stability of the charging property and the low temperature fixability. When the average circularity is within the above range, the individual toner particle is less crushable. This prevents the triboelectrifying member from smudges and stabilizes the charging property of the toner. Further, the image quality in images to be formed is enhanced In the present invention, the average circularity of the toner is measured by an "FPIA-2100" (manufactured by Sysmex Corp.).

Specifically, a sample (toner) is mixed well with an aqueous solution containing a surfactant and is further dispersed by performing an ultrasonic dispersion treatment for 1 minute. Thereafter, images are taken by means of the "FPIA-3000" (manufactured by Sysmex Corp.) under the measurement conditions of the HPF (high power imaging) mode at an adequate concentration of an HPF detection number of 3000 to 10000. The average circularity of the toner is calculated by determining the circularity of each toner particle according to the following Equation (T), adding up the circularities of each of the toners, and dividing the sum of the circularities by the total number of the toner particles.

$$\text{Circularity}=(\text{Circumference of circle having same area as projected image of particle})/(\text{Perimeter of projected image of particle}) \quad \text{Equation (T):}$$

<Softening Point of Toner>

The softening point of the toner is preferably within a range of 80 to 120° C., and more preferably 90 to 110° C., from the viewpoint of providing low temperature fixability to the toner.

The softening point of the toner is measured by a flow tester shown below.

Specifically, 1.1 g of a sample (toner) is placed and flattened in a petri dish in the environment of 20° C. and 50% RH. After left for at least 12 hours, the sample is pressed at a pressure of 3820 kg/cm$^2$ for 30 seconds by means of a shaping machine "SSP-10A" (manufactured by SHIMADZU CORPORATION) to form a cylindrically shaped sample having a diameter of 1 cm. Then, at the end of preheating, the shaped sample is extruded from a hole (1 mm in diameter×1 mm) of a cylindrical die by using a flow tester "CFT-500D" (manufactured by SHIMADZU CORPORATION) with a 1 cm-diameter piston under the conditions of a load of 196 N (20 kgf), an initial temperature of 60° C., a preheating time of 300 seconds, and a temperature raising rate of 6° C./minute in an environment of 24° C. and 50% RH. The offset temperature $T_{offset}$ measured by a melting temperature measurement method of a temperature raising method with an offset value set at 5 mm is taken as the softening point.

[Method for Producing Toner]

The toner according to the present invention can be produced by a production method including the following procedure. However, only one example is disclosed here, and the present invention is not limited to the following exemplary production method.

The toner of the present invention is preferably produced by a wet method, in which the toner is prepared in an aqueous medium, and can be produced by an emulsion aggregation method, for example.

The emulsion aggregation method is a method for producing a toner that includes mixing an aqueous dispersion of resin particles constituting a binder resin with an aqueous dispersion of particles of other toner constituents, as required, allowing the particles to slowly aggregate and associate with one another while the average particle size and the particle size distribution are controlled by keeping a balance between the repulsive force of the particle surface by means of pH adjustment and the cohesive force by means of addition of an electrolyte coagulant, and simultaneously with the association, fusing the fine particles to one another by heating and stirring the dispersion to thereby controlling the shape of the particles.

Hereinbelow, as one example of the method for producing a toner, a case in which a crystalline polyester resin and an amorphous resin are used as a binder resin will be described.

As an specific example, the method for producing a toner includes:

(1) a colorant particle dispersion preparation step of dispersing a colorant in an aqueous medium to prepare a colorant particle dispersion;

(2) a crystalline polyester resin particle dispersion preparation step of dispersing a crystalline polyester resin in an aqueous medium to prepare a crystalline polyester resin particle dispersion;

(3) an amorphous resin particle dispersion preparation step of dispersing an amorphous resin (an amorphous polyester resin and an amorphous vinyl resin) containing, as required, toner constituents such as a release agent and a charge control agent in an aqueous medium to prepare an amorphous resin particle dispersion (an amorphous polyester resin particle dispersion and an amorphous vinyl resin particle dispersion);

(4) an aggregation and fusion step of aggregating and fusing the amorphous resin particles, the crystalline polyester resin particles, and the colorant particles in an aqueous medium to form aggregated particles using each dispersion obtained above (1) to (3);

(5) an aging step of aging the aggregated particles by heat energy to adjust the shape, so as to prepare a toner base particle dispersion;

(6) a cooling step of cooling the toner base particle dispersion;

(7) a filtering and washing step of solid-liquid separating the toner base particles from the cooled toner base particle dispersion and removing the surfactant and the like from the surface of the toner base particles;

(8) a drying step of drying the washed toner base particles; and (9) an external additive addition step of adding an external additive to the dried toner base particles.

In the present invention, the term "aqueous medium" refers to a medium composed of 50 to 100% by mass of water and 0 to 50% by mass of a water-soluble organic solvent. Examples of such water-soluble organic solvents can include methanol, ethanol, isopropanol, butanol, acetone, methylethylketone, and tetrahydrofuran. Alcohol organic solvents that do not dissolve the resulting resin are preferably used.

(1) Colorant Particle Dispersion Preparation Step

The colorant particle dispersion can be prepared by dispersing the colorant in an aqueous medium. The dispersion treatment of the colorant, in which the colorant is uniformly dispersed, is preferably performed in a state where the surfactant concentration is made to be equal to or higher than the critical micelle concentration (CMC) in an aqueous medium. As a disperser to be used in the dispersion treatment of the colorant, various known dispersers can be used.

(Surfactant)

Examples of the surfactant include anionic surfactants such as alkyl sulfates, polyoxyethylene (n)alkylether sulfates, alkylbenzene sulfonates, α-olefin sulfonates, and phosphates; cationic surfactants including amine salt surfactants such as alkyl amine salts, aminoalcohol fatty acid derivatives, polyamine fatty acid derivatives, and imidazoline, and quaternary ammonium surfactants such as alkyltrimethylammonium salts, dialkyldimethylannmonium salts, alkyldimethylbenzylannmonium salts, pyridinium salts, alkylisoquinolinium salts, and benzethonium chloride; nonionic surfactants such as fatty acid amide derivatives and polyhydric alcohol derivatives; and amphoteric surfactants such as alanine, dodecyldi(aminoethyl)glycine, di(octylaminoethyl)glycine, and N-alkyl-N,N-dimethylannmonium betaine. In addition, anionic surfactants and cationic surfactants having a fluoroalkyl group may also be used.

The dispersion diameter of the colorant particles of the colorant particle dispersion prepared in this colorant particle dispersion preparation step is preferably within a range of 10 to 300 nm in a volume-based median diameter. The volume-based median diameter of the colorant particles in this colorant particle dispersion is measured by an electrophoretic light scattering spectrometer "ELS-800 (manufactured by Otsuka Electronics Co., Ltd.)".

The colorant may be introduced to the toner by being dissolved or dispersed in a monomer solution for producing the amorphous resin in advance using a miniemulsion method, in the following amorphous resin particle dispersion preparation step.

(2) Crystalline Polyester Resin Particle Dispersion Preparation Step

Examples of the method for dispersing a crystalline polyester resin in an aqueous medium include an aqueous direct dispersion method of dispersing a crystalline polyester resin in an aqueous medium containing a surfactant by means of an ultrasonic dispersion method or bead mill dispersion method, a dissolution-emulsification-desolvation method of dissolving a crystalline polyester resin in a solvent, dispersing the solution in an aqueous medium to form emulsion particles (oil particles), and then removing the solvent, and a phase-inversion emulsification method.

The average particle size of the crystalline polyester resin particles obtained in this crystalline polyester resin particle dispersion preparation step is, for example, preferably within a range of 50 to 500 nm in a volume-based median diameter. Note that the volume-based median diameter is measured by a "UPA-EX150" (manufactured by Microtrac-BEL Corp.).

(3) Amorphous Resin Particle Dispersion Preparation Step

When the amorphous resin is an amorphous polyester resin, an amorphous polyester resin particle dispersion can be prepared by dispersing the synthesized amorphous polyester resin in an aqueous medium. As a method for dispersing the amorphous polyester resin in an aqueous medium, the same method can be employed as the method for dispersing the crystalline polyester resin in an aqueous medium described above.

When the amorphous resin is an amorphous vinyl resin, an amorphous vinyl resin particle dispersion can be prepared by adding an polymerizable monomer for forming the amorphous vinyl resin in an aqueous medium containing a surfactant at a concentration equal to or higher than the critical micelle concentration (CMC) and adding a water-soluble polymerization initiator at a desired polymerization temperature under stirring so as to polymerize the monomer.

Similarly, when the amorphous resin is an amorphous vinyl resin, an amorphous resin particle dispersion can be also prepared by adding a solution including toner constituents such as a release agent, a charge control agent, and the like dissolved or dispersed, as required, with respect to a polymerizable monomer for forming the amorphous vinyl resin, into an aqueous medium containing a surfactant at a concentration equal to or lower than the critical micelle concentration (CMC), applying mechanical energy to form droplets, and then adding a water-soluble radical polymerization initiator to allow a polymerization reaction to proceed in the droplets. Note that an oil-soluble polymerization initiator may be contained in the droplets. In such an amorphous resin particle dispersion preparation step, essential is an emulsification (droplet formation) treatment by means of application of mechanical energy. Examples of such measures for applying mechanical energy can include measures for applying intensive agitation or ultrasonic vibration energy, such as a homomixer, an ultrasonic, and a Manton-Gaulin device.

The amorphous resin particles to be formed in this amorphous resin particle dispersion preparation step may have a structure of two or more layers constituted of resins each having a different composition. In this case, a method can be employed which includes preparing a dispersion of resin particles by an emulsification polymerization treatment in accordance with a routine method (first stage polymerization), adding a polymerization initiator and a polymerizable monomer to the dispersion, and subjecting this system to a polymerization treatment (second stage polymerization and third stage polymerization).

When a surfactant is used in this step, ones similar to the surfactants described above may be used as the surfactant.

(Polymerization Initiator)

As the polymerization initiator to be used, various known polymerization initiators can be used. Specific examples thereof include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxydicarbonate, tetralin hydroperoxide, 1-phenyl-2-methylpropyl-1-hydroperoxide, tert-hydroxyperoxide triphenylperacetate, tert-butyl performate, tert-butyl peracetate, tert-butyl perbenzoate, tert-butyl phenylperacetate, tert-butyl methoxyperacetate, and tert-butyl N-(3-toluyl)perpalmitate; and azo compounds such as 2,2'-azobis(2-amidinopropane) hydrochloride, 2,2'-azobis-(2-amidinopropane) nitrate, 1,1'-azobis(sodium 1-methylbutyronitrile-3-sulfonate), 4,4'-azobis-4-cyanovaleric acid, and poly(tetraethylene glycol-2,2'-azobisisobutyrate). Among these, water-soluble polymerization initiators, such as ammonium persulfate, sodium persulfate, potassium persulfate, hydrogen peroxide, 2,2'-azobis(2-amidinopropane) hydrochloride, 2,2'-azobis-(2-amidinopropane) nitrate, 1,1'-azobis(sodium 1-methylbutyronitrile-3-sulfonate), and 4,4'-azobis-4-cyanovaleric acid are preferably used.

Also, redox polymerization initiators such as a persulfate with a metabisulfite and hydrogen peroxide with ascorbic acid can be also used as the polymerization initiator.

(Chain Transfer Agent)

In the amorphous resin (particularly amorphous vinyl resin) particle dispersion preparation step, a generally-used chain transfer agent can be employed for the purpose of adjusting the molecular weight of the amorphous resin. The chain transfer agent is not particularly limited, and examples thereof can include alkylmercaptan and mercapto fatty acid esters.

The average particle size of the amorphous resin particles obtained in this amorphous resin particle dispersion preparation step is preferably in a range of 50 to 500 nm in a volume-based median diameter. Note that the volume-based median diameter is measured by a "UPA-EX150" (manufactured by MicrotracBEL Corp.).

(4) Aggregation and Fusion Step

This step is to aggregate and fuse the colorant particles, amorphous resin particles, and crystalline polyester resin particles contained in the dispersion formed in the steps described above in an aqueous medium. In this step, the amorphous resin particle dispersion, crystalline polyester resin particle dispersion, and colorant particle dispersion are added to an aqueous medium, and these particles are aggregated and fused to one another.

As a specific method for aggregating and fusing the colorant particles, amorphous resin particles, and crystalline polyester resin particles, provided is a method that includes adding a coagulant to an aqueous medium to a concentration equal to or higher than the critical aggregation concentration, then heating the dispersion at a temperature equal to or higher than both the glass transition point of the amorphous resin particles and the melting peak temperature of the release agent and the crystalline polyester resin, so as to allow salting out and fusion of the particles including the colorant particles, the amorphous resin particles, and the crystalline polyester resin particles to proceed simultaneously, adding an aggregation terminator when the particles are grown to a desired particle size, so as to terminate the growth of the particles, and as required, further heating the dispersion continuously in order to control the particle shape.

In this method, it is preferred that the time for which the dispersion is left after addition of the coagulant be shortened as much as possible and the dispersion be rapidly heated to a temperature equal to or higher than the glass transition point of the amorphous resin particles according to the binder resin. The reason therefor is not clear, but it is feared that problems may occur such as change of the aggregated state of the particles that leads to unstable particle size distribution and variation in the surface properties of the fused particles, depending on the length of the time for which the dispersion is left after the salting out. The time before this temperature rise is typically preferably 30 minutes or less, and more preferably 10 minutes or less.

Further, the temperature raising rate is preferably 1° C./minute or more. The upper limit of the temperature raising rate in not particularly specified, but is preferably 15° C./minute or less, from the viewpoint of preventing coarse particles from occurring due to progress of rapid fusion. Further, it is important that after the temperature of the reaction system reaches a temperature equal to or higher than the glass transition point, the temperature of the system is held at the same temperature for a certain period of time so as to allow the fusion to continue. This allows the growth and fusion of the toner to proceed effectively, which can improve the durability of the resultant toner.

(Coagulant)

The coagulant used is not particularly limited, but ones selected from metal salts are suitably used. Examples of the metal salt include monovalent metal salts such as salts of alkali metals including sodium, potassium and lithium; divalent metal salts such as salts of calcium, magnesium, manganese, and copper; and trivalent metal salts such as salts of iron and aluminum. Specific examples of the metal salt include sodium chloride, potassium chloride, lithium chloride, calcium chloride, magnesium chloride, zinc chloride, copper sulfate, magnesium sulfate, and manganese sulfate. Among these, use of a divalent metal salt are particularly preferable because aggregation is allowed to proceed with a smaller amount of the salt and additionally, the aggregation property is easily controlled. One of these may be used singly, or two or more of these may be used in combination.

When a surfactant is used in this step, ones similar to the surfactants described above may be used as the surfactant.

(5) Aging Step

Specifically, this step is a step of forming the toner base particles by stirring and heating the system containing the aggregated particles while the heating temperature, stirring speed, and heating time are controlled until the shape of the aggregated particle reaches a desired average circularity. In this step, the shape of the toner base particles is preferably controlled by heat energy (heating).

(6) Cooling Step to (8) Drying Step

For the cooling step, the filtering and washing step, and the drying step can be performed by employing various known methods.

(9) External Additive Addition Step

The external additive addition step is a step of adding and mixing an external additive to the dried toner base particles.

An exemplary method for adding the external additive is a dry method in which a powder external additive is added and mixed to the dried toner base particles. As a mixing apparatus, a mechanical mixing apparatus such as a Henschel mixer and a coffee mill can be used.

[Developer]

The toner of the present invention can be used as a magnetic or non-magnetic monocomponent developer, or may be mixed with a carrier and used as a two-component developer.

For the carrier, magnetic particles constituted of conventional known materials may be used, including metals such as ferrite and magnetite, alloys of such a metal with another metal such as aluminum, lead, and the like. Among these, ferrite particles are preferably used. Also, coated carriers, in which the surface of magnetic particles is coated with a coating agent such as a resin, and resin dispersed carriers, in which magnetic fine particles are dispersed in a binder resin, may be used for the carrier.

The volume average particle size of the carrier is preferably within a range of 15 to 100 μm, and more preferably within a range of 25 to 80 μm.

[Image Formation Apparatus]

The toner of the present invention can be used in a common electrophotographic image forming method. As an image formation apparatus with which such an image forming method is performed, an image formation apparatus can be used, the apparatus including a photoreceptor, which is, for example, an electrostatic image carrier, a charging unit to apply an uniform potential to the surface of the photoreceptor by corona discharge having the same polarity as the toner, an exposing unit to image-expose the uniformly charged surface of the photoreceptor based on an image data to form an electrostatic image, a developing unit to convey the toner to the surface of the photoreceptor and develop the electrostatic image to form a toner image, a transferring unit to transfer the toner image onto a transfer material via an intermediate transfer body as required, and a fixing unit to heat and fix the toner image on the transfer material.

Further, the toner of the present invention can be suitably used for image formation apparatuses having a relatively low fixing temperature (surface temperature of the fixing member) of 130 to 200° C.

Further, the toner of the present invention can be suitably used for image formation apparatuses that have a fixing speed (paper conveying speed) within a range of 50 mm/sec to 700 mm/sec, and preferably within a range of 300 to 700 mm/sec.

Although embodiments of the present invention have been described and illustrated in detail, the disclosed embodiments are made for purposes of illustration and example only and not limitation. The scope of the present invention should be interpreted by terms of the appended claims

EXAMPLES

Hereinafter, the present invention will be specifically described by referring to Examples. However, the present invention is not limited to these Examples.

Compounds used in the Examples below are as follows.

Copper phthalocyanine compound P1: C.I. Pigment Blue 15:4

Copper phthalocyanine compounds P2 to P5: C.I. Pigment Blue 15:3 with a different aspect ratio

[Preparation of Colorant Dispersion]

<Preparation of Cyan Colorant Particle Dispersion D1>

13 parts by mass of sodium n-dodecyl sulfate was introduced into 77 parts by mass of ion exchanged water, which was stirred for dissolution to prepare a surfactant solution. To this surfactant solution, 10 parts by mass of a copper phthalocyanine compound P1 was gradually added as a colorant of a cyan toner. After completing the addition, the resultant was subjected to a dispersion treatment as preliminary dispersion with an "SC mill" (manufactured by Nippon Coke & Engineering Co., Ltd.) in which zirconia beads (φ0.8 mm) were used at a filling ratio of 75%, and further subjected to a dispersion treatment as main dispersion with an "SC mill" in which zirconia beads (φ0.3 mm) were used at a filling ratio of 75% to prepare an aqueous dispersion D1 of cyan colorant particles.

A median diameter $D_{50}$ of the colorant particles in the prepared cyan colorant particle dispersion D1 measured with a Microtrac's particle size distribution analyzer "UPA-EX150" (manufactured by MicrotracBEL Corp.) was 140 nm. Further, the pH (25° C.) of the cyan colorant particle dispersion D1 was 9.12.

<Preparation of Cyan Colorant Particle Dispersion D2>

A cyan colorant particle dispersion D2 was prepared in the same manner as in the preparation of the cyan colorant particle dispersion D1 except that the copper phthalocyanine compound P1 was changed to P2. A median diameter D50 of the colorant particles in the prepared cyan colorant particle dispersion D2 was measured, and the results are shown in Table I.

<Preparation of Cyan Colorant Particle Dispersion D4>

13 parts by mass of sodium n-dodecyl sulfate was introduced into 77 parts by mass of ion exchanged water, which was stirred for dissolution to prepare a surfactant solution. To this surfactant solution, 10 parts by mass of a copper phthalocyanine compound P4 was gradually added as a colorant of a cyan toner. After completing the addition, the resultant was subjected to a dispersion treatment with an "SC mill" (manufactured by Nippon Coke & Engineering Co., Ltd.) in which zirconia beads (φ0.3 mm) were used at a filling ratio of 75% to prepare an aqueous dispersion D4 of cyan colorant particles. A median diameter $D_{50}$ of the colorant particles in the prepared cyan colorant particle dispersion D4 measured with a Microtrac's particle size distribution analyzer "UPA-EX150" (manufactured by MicrotracBEL Corp.) was 156 nm. Further, the pH (25° C.) of the cyan colorant particle dispersion D4 was 7.55.

<Preparation of Cyan Colorant Particle Dispersions D3 and D5>

Cyan colorant particle dispersions D3 and D5 were prepared in the same manner as in the preparation of the cyan colorant particle dispersion D1 except that the copper phthalocyanine compound P1 was changed to P3 and P5, respectively, and the preliminary dispersion was performed using ultrasonic waves in place of the zirconia beads. A median diameter $D_{50}$ of the colorant particles in the prepared cyan colorant particle dispersions D3 and D5 was measured, and the results are shown in Table I.

TABLE 1

| Cyan colorant particle dispersion No. | Copper phthalocyanine compound No. | CI. Pigment No. | pH | Dispersion condition: Preliminary dispersion | Dispersion condition: Main dispersion | Median diameter $D_{50}$ [nm] of colorant particles in dispersion |
|---|---|---|---|---|---|---|
| D1 | P1 | Blue15:4 | 9.12 | Bead mill | Bead mill | 140 |
| D2 | P2 | Blue15:3 | 7.32 | Bead mill | Bead mill | 153 |
| D3 | P3 | Blue15:3 | 7.46 | Ultrasonic waves | Bead mill | 160 |
| D4 | P4 | Blue15:3 | 7.55 | Stirring | Bead mill | 156 |
| D5 | P5 | Blue15:3 | 7.25 | Ultrasonic waves | Bead mill | 167 |

[Synthesis of Resin and Preparation of Aqueous Dispersion of Resin Particles]

<Synthesis of Amorphous Vinyl Resin v1>

(First Polymerization)

In a 5-L reaction vessel equipped with a stirrer, a temperature sensor, a cooling tube, and a nitrogen-introducing device, a solution in which 8 g of sodium dodecyl sulfate was dissolved in 3 L of ion exchanged water was placed and the internal temperature was raised to 80° C. with stirring at a stirring speed of 230 rpm under nitrogen gas flow. After that, a solution in which 10 g of potassium persulfate was dissolved in 200 g of ion exchanged water was added thereto and the solution temperature was raised to 80° C. again.

A monomer mixture solution prepared by mixing the following components in an amount described below was dropwise added to the resultant solution over 1 hour, which was then heated and stirred for 2 hours at 80° C. to carry out polymerization. As a result, a resin fine particle dispersion X1 in which resin fine particles x1 were dispersed was prepared.

| | |
|---|---|
| Styrene | 480 g |
| n-Butylacrylate | 250 g |
| Methacrylic acid | 68 g |

(Second Polymerization)

In a 5-L reaction vessel equipped with a stirrer, a temperature sensor, a cooling tube, and a nitrogen-introducing device, a solution in which 7 g of polyoxyethylene (2) sodium dodecyl ether sulfate was dissolved in 1460 mL of ion exchanged water was placed and heated to 88° C.

To the resultant solution, the resin fine particle dispersion X1 in an amount of 80 g in terms of the resin fine particles x1 was added, and a monomer solution containing the following components in an amount described below and having a temperature of 80° C. was further added to the solution. The resultant solution was mixed and dispersed for 1 hour with a mechanical disperser having a circulation pathway "CLEARMIX" (manufactured by M Technique Co., Ltd., "CLEARMIX" is a registered trademark of M Technique Co., Ltd.) to prepare a dispersion containing emulsified particles (oil drops).

| | |
|---|---|
| Styrene | 245 g |
| n-Butylacrylate | 95 g |
| Methacrylic acid | 35 g |
| n-Octyl-3-mercaptopropionate | 4.0 g |

Next, to the prepared dispersion, an initiator solution in which 6 g of potassium persulfate was dissolved in 200 mL of ion exchanged water was added, and this system was then heated and stirred for 1 hour at 82° C. to carry out polymerization. As a result, a resin fine particle dispersion X2 in which resin fine particles x2 were dispersed was prepared.

(Third Polymerization)

To the resin fine particle dispersion X2, a solution in which 11 g of potassium persulfate was dissolved in 400 mL of ion exchanged water was added, and a monomer composition containing the following components in an amount described below was dropwise added thereto over 1 hour under the temperature condition of 82° C. After the dropwise addition, the resultant was heated and stirred for 2 hours to carry out polymerization. After that, the resultant dispersion was cooled to 28° C. Accordingly, an amorphous vinyl resin v1 as an amorphous vinyl-based resin was prepared.

| | |
|---|---|
| Styrene | 405 g |
| n-Butylacrylate | 160 g |
| Methacrylic acid | 33 g |
| n-Octyl-3-mercaptopropionate | 10 g |

An aqueous dispersion, which was prepared by diluting a dispersion of the amorphous vinyl resin v1 with ion exchanged water so that the aqueous dispersion has 30% by mass of the amorphous vinyl resin v1, was referred to as V1. A volume-based median diameter $D_{50}$ of the amorphous resin v1 particles in the aqueous dispersion V1 was 215 nm. Further, a weight average molecular weight Mw of the amorphous vinyl resin v1 was 30800.

<Synthesis of Amorphous Polyester Resin a1>

In a reaction vessel equipped with a stirrer, a nitrogen-introducing tube, a temperature sensor, and a rectifying column, the following components in an amount described below were placed. "BPA-PO" represents a 2,2-bis(4-hydroxyphenyl)propane propylene oxide 2-mol adduct, and "BPO-EO" represents a 2,2-bis(4-hydroxyphenyl)propane ethylene oxide 2-mol adduct. A fumaric acid and a terephthalic acid correspond to a polyvalent carboxylic acid, and BPA-PO and BPO-EO correspond to a polyhydric alcohol.

| | |
|---|---|
| Fumaric acid (FA) | 1.8 parts by mass |
| Terephthalic acid (TA) | 29.2 parts by mass |
| BPA-PO | 58.2 parts by mass |
| BPO-EO | 6.7 parts by mass |

The temperature of the resultant mixture was raised to 190° C. over 1 hour. After confirming that the mixture was uniformly stirred, dibutyltin oxide in an amount of 0.006% by mass relative to a total amount of the polyvalent carboxylic acid was introduced thereto as a catalyst, and the temperature of the mixture was raised from 190° C. to 240° C. over 6 hours while removing generated water by distillation. When the temperature reached 240° C., 1.6 parts by mass of a trimellitic acid was added to the mixture. After that, dehydration condensation reaction was kept going to carry out the polymerization reaction until the acid value of the generated product was 21 mgKOH/g with the temperature being further maintained at 240° C. to give an amorphous polyester resin a1 as amorphous polyester. The prepared amorphous polyester resin a1 had a number average molecular weight (Mn) of 3600 and a glass transition temperature (Tg) of 62° C. The acid value, Mn, and Tg of the amorphous polyester resin a1 were measured as described above.

<Preparation of Aqueous Dispersion A1 of Amorphous Polyester Resin Particles>

To a reaction vessel equipped with an anchor-shaped blade that supplies power for stirring, 240 parts by mass of methyl ethyl ketone and 60 parts by mass of isopropyl alcohol (IPA) were added, and nitrogen was supplied to the reaction vessel to purge the air in the reaction vessel with nitrogen.

Next, 300 parts by mass of the amorphous polyester resin a1 was gradually added to the mixture solution and stirred for dissolution while heating the mixture solution in the reaction vessel to 60° C. by an oil bath.

Next, 20 parts by mass of 10% aqueous ammonia was added to the resultant mixture solution, and 1500 parts by mass of deionized water was then introduced into the resultant mixture solution by a metering pump with stirring. The resultant mixture solution turned milky white color and was low in stirring viscosity, which established that emulsification was carried out.

After that, the obtained emulsified liquid was pumped using differential pressure based on a centrifugal force and transferred to a separable flask equipped with a stirring blade, a reflux device, and a vacuum pump as a decompression device to form a wet wall on the wall surface of the reactor. While setting a wall temperature of the reactor at 58° C. and continuously stirring the obtained emulsified liquid under the condition of reduced pressure, a solvent and a dispersion medium in the emulsified liquid were removed by distillation. The distillation was terminated at the point of time at which an amount of dispersion to be prepared reached 1000 parts by mass. The internal pressure of the reactor was brought back to normal pressure and the dispersion was cooled to normal temperature with stirring to give an aqueous dispersion A1 of amorphous polyester resin a1 particles having a solid content of 30% by mass. A volume-based median diameter ($D_{50}$) of the resin particles dispersed in the aqueous dispersion A1 was 162 nm.

<Synthesis of Crystalline Polyester Resin b1>

In a reaction vessel equipped with a stirrer, a nitrogen-introducing tube, a temperature sensor, and a rectifying column, the following components in an amount described below were placed. The sebacic acid corresponds to a polyvalent carboxylic acid.

| | |
|---|---|
| Sebacic acid (SA) | 205 parts by mass |
| Ethylene glycol | 61 parts by mass |

The temperature of the mixture of the above components was raised to 190° C. over 1 hour. After confirming that the mixture was uniformly stirred, $Ti(OBu)_4$ in an amount of 0.006% by mass relative to a total amount of the polyvalent carboxylic acid was introduced into the reaction vessel as a catalyst. Further, the temperature of the mixture was raised from 190° C. to 240° C. over 6 hours while removing generated water by distillation. Then, dehydration condensation reaction was kept going to carry out the polymerization reaction until the acid value of the generated product was 20 mgKOH/g with the temperature being further maintained at 240° C. to give a crystalline polyester resin b1.

<Preparation of Aqueous Dispersion B1 of Crystalline Polyester Resin Particles>

To a reaction vessel equipped with an anchor-shaped blade that supplies power for stirring, 300 parts by mass of methyl ethyl ketone was added, and nitrogen was supplied to the reaction vessel to purge the air in the reaction vessel with nitrogen.

Next, 300 parts by mass of the crystalline polyester resin b1 was gradually added to the mixture solution and stirred for dissolution while heating methyl ethyl ketone in the reaction vessel to 70° C. by an oil bath.

Next, 20 parts by mass of 10% aqueous ammonia was added to the resultant mixture solution, and 1500 parts by mass of deionized water was then introduced into the resultant mixture solution by a metering pump with stirring. The resultant mixture solution turned milky white color and was low in stirring viscosity, which established that emulsification was carried out.

After that, the obtained emulsified liquid was pumped using differential pressure based on a centrifugal force and transferred to a separable flask equipped with a stirring blade, a reflux device, and a vacuum pump as a decompression device to form a wet wall on the wall surface of the reactor. While setting a wall temperature of the reactor at 58° C. and continuously stirring the obtained emulsified liquid under the condition of reduced pressure, a solvent and a dispersion medium in the emulsified liquid were removed by distillation. The distillation was terminated at the point of time at which an amount of dispersion to be prepared reached 1000 parts by mass. The internal pressure of the reactor was brought back to normal pressure and the dispersion was cooled to normal temperature with stirring to give an aqueous dispersion B1 of crystalline polyester resin b1 particles having a solid content of 30% by mass.

[Preparation of Aqueous Dispersion W1 of Release Agent Particles]

50 parts by mass of "Nissan Electol WEP-3" (manufactured by NOF Corporation, melting point (Tm): 73° C., "Nissan Electol" and "WEP" are both registered trademarks of NOF Corporation), 5 parts by mass of polyoxyethylene-2-sodium dodecyl ether sulfate, and 195 parts by mass of ion exchanged water were mixed and heated to 90° C. The mixture was thoroughly dispersed with a homogenizer "ULTRA-TURRAX T50" (manufactured by IKA-Werke GmbH & Co. KG), followed by a dispersion treatment with a pressurized ejection-type Gaulin homogenizer to give an aqueous dispersion W1 of release agent particles. A volume-based median diameter $D_{50}$ of the release agent particles in the aqueous dispersion W1 was 170 nm. "Nissan Electol WEP-3" is a refined product containing behenyl behenate (BB) as a main component.

[Production of Toner Particles T1]

Into a reaction vessel equipped with a stirrer, a temperature sensor, a cooling tube, and a nitrogen-introducing device, 2333 parts by mass of the aqueous dispersion V1 of amorphous vinyl resin particles (700 parts by mass as a solid content), the cyan colorant particle dispersion D1 in an amount of 3.3% by mass relative to an amount of the toner, 375 parts by mass of the aqueous dispersion W1 of release agent particles (75 parts by mass as a solid content), and 942 parts by mass of ion exchanged water were introduced. To the prepared mixture solution, 5 mol/L of an aqueous sodium hydroxide was added with stirring to adjust the pH of the mixture solution to 10 (20° C.).

Next, to the above mixture solution, an aqueous solution in which 160 parts by mass of magnesium chloride was dissolved in 160 parts by mass of ion exchanged water was added at a rate of 10 parts by mass/minute. After the resultant was left to stand for 5 minutes, the temperature of the resultant mixture solution was started to be raised, and raised to 80° C. over 60 minutes. The mixture solution was left to stand for 5 minutes after the temperature raising was completed, and 267 parts by mass of the aqueous dispersion B1 of crystalline polyester resin particles (80 parts by mass as a solid content) was added to the mixture solution at a rate of 25 parts by mass/minute. After the resultant was left to stand for 15 minutes, aggregation reaction was initiated. After the initiation of this aggregation reaction, a sample was taken on a regular basis to measure a volume-based median diameter $D_{50}$ of generated aggregated particles with a particle size distribution analyzer "Coulter Multisizer 3" (manufactured by Beckman Coulter, Inc.), and the mixture was kept stirring until the $D_{50}$ was 6.3 μm while slowing down the stirring speed as necessary to allow the aggregation reaction to proceed.

The stirring speed was again increased at the point of time at which the $D_{50}$ was 6.3 μm, and 333 parts by mass of the aqueous dispersion A1 of amorphous polyester resin particles (100 parts by mass as a solid content) was added at a rate of 25 parts by mass/minute.

A sample was taken on a regular basis to confirm that a supernatant resulted from centrifugal separation turned transparent. After that, an aqueous solution in which 300 parts by mass of sodium chloride was dissolved in 1200 parts by mass of ion exchanged water was added to the mixture solution, which was kept stirring with a temperature of the mixture solution being set at 85° C. When an average circularity of particles in the mixture solution measured with a flow type particle image analyzer "FPIA-3000" (manufactured by Sysmex Corporation, "FPIA" is a registered trademark of Sysmex Corporation) reached 0.952, the mixture solution was cooled to 30° C. under the condition of 6° C./minute to terminate the aggregation reaction. As a result, a dispersion of toner base particles was prepared. A particle size ($D_{50}$) of the cooled toner base particles was 6.3 μm and the average circularity thereof was 0.952.

The prepared dispersion of toner base particles was subjected to solid-liquid separation with a basket centrifuge "MARK III 60×40 model" (manufactured by Matsumoto Machine Manufacturing Co., Ltd.) to give a wet cake. The prepared wet cake was repeatedly subjected to washing and the solid-liquid separation with the basket centrifuge until electric conductivity of a filtrate was 15 μS/cm, and the washed cake was then supplied little by little to "Flash jet dryer" (manufactured by Seishin Enterprise Co., Ltd.) in which airflow having a temperature of 40° C. and a humidity of 20% RH was blown to perform a drying treatment until the cake has a water content of about 2.0% by mass, followed by cooling to 24° C. After that, the cake was transferred to "Vibration fluidized bed device" (manufactured by Chuo Kakohki Co., Ltd.) and dried for 2 hours with a temperature of the cake being 40° C. to give toner base particles 1× having a water content of 0.5% or less.

To the prepared toner base particles 1×, 1% by mass of hydrophobic silica and 1.2% by mass of a hydrophobic titanium oxide were added, which was mixed with "Henschel mixer" (manufactured by Nippon Coke & Engineering Co., Ltd.) at a circumferential velocity of a rotating blade of 24 mm/sec for 20 minutes. The resultant was then subjected to a treatment with an external additive in which coarse particles were removed using a 400-mesh sieve to produce toner particles.

Further, to the toner particles, a ferrite carrier having a volume average particle size of 60 μm, which was coated with a silicone resin, was added and mixed so that a toner particle concentration was 6% by mass. Accordingly, a toner T1 as a two-component developer was produced.

[Production of Toners T2 to T5]

Toners T2 to T5 were produced in the same manner as in the production of the toner T1 except that the kind of the cyan colorant particle dispersion D1 and the amount added (the amount of a pigment added in the toner) were changed as shown in Table II below.

[Production of Toner T6]

A toner T6 was produced in the same manner as in the production of the toner T1 except that the cyan colorant particle dispersions D4 and D5 were used in place of the cyan colorant particle dispersion D1, and these dispersions were added so that the amount of the cyan colorant particle dispersion D4 in the toner was 2.94% by mass and the amount of the cyan colorant particle dispersion D5 in the toner was 1.26% by mass.

[Production of Toner T7]

A toner T7 was produced in the same manner as in the production of the toner T1 except that the cyan colorant particle dispersions D1 and D4 were used in place of the cyan colorant particle dispersion D1, and these dispersions were added so that the amount of the cyan colorant particle dispersion D1 in the toner was 3.24% by mass and the amount of the cyan colorant particle dispersion D4 in the toner was 0.36% by mass.

[Method for Measuring Various Properties]

<Measurement Method of Weight Average Molecular Weight Mw and Number Average Molecular Weight Mn>

Mw and Mn of each resin are determined by the following method.

With a device "HLC-8320GPC" (manufactured by Tosoh Corporation) and columns "TSKgel guard column Super HZ-L" and "TSKgel Super HZM-M" (manufactured by Tosoh Corporation), tetrahydrofuran (THF) as a carrier solvent is poured at a flow rate of 0.2 mL/minute while maintaining a column temperature at 40° C. and a measurement sample (for example, the amorphous vinyl resin a1) is dissolved in THF under a dissolution condition in which a treatment is performed with a ultrasonic disperser for 5 minutes at room temperature so that a concentration of the measurement sample in THF is 1 mg/mL.

Next, the resultant solution is treated with a membrane filter having a pore size of 0.2 μm to give a sample solution, and 10 μL of this sample solution is injected together with the carrier solvent into the device and detected with a refractive index detector (RI detector). A molecular weight distribution of the measurement sample is calculated using a calibration curve which is measured using 10 monodispersed polystyrene standard particles.

<Measurement Method of Glass Transition Temperature Tg>

The glass transition temperature Tg of each resin is measured in accordance with the method (DSC method) specified in ASTM (American Society for Testing and Materials standard) D3418-82. That is, 4.5 mg of a measurement sample (amorphous resin), which is precisely weighed to two decimal places, enclosed in an aluminum pan, and placed on a sample holder of a differential scanning calorimeter "DSC8500" (manufactured by PerkinElmer, Inc.). As a reference, an empty aluminum pan is used, and temperature control of temperature raising—temperature lowering—temperature raising is performed at a measurement temperature of −10 to 120° C., at a temperature raising rate of 10° C./minute and a temperature lowering rate of 10° C./minute. Analysis is performed based on the data obtained during the second temperature raising. The value of the intersection of a line extended from the base line before the first endothermic peak rises up and a tangent line which represents the maximum slope of the first endothermic peak within the range from the rise-up point to the apex of the peak is taken as the glass transition temperature.

<Measurement Method of Acid Value>

The acid value represents a mass of a potassium hydroxide (KOH), which is expressed in milligrams, necessary for neutralizing an acid contained in 1 g of a sample. The acid value of a resin is measured by the following procedure in accordance with JIS K0070-1992.

(Preparation of Reagent)

1.0 g of phenolphthalein is dissolved in 90 mL of ethyl alcohol (95 volume %), and ion exchanged water is added to make the volume 100 mL to prepare a phenolphthalein solution. 7 g of a JIS special grade potassium hydroxide is dissolved in 5 mL of ion exchanged water, and ethyl alcohol (95 volume %) is added to make the volume 1 L. The resultant solution is put into an alkali-resistant container without letting the solution come in contact with a carbon dioxide and then left to stand for 3 days, which is then filtered to prepare a potassium hydroxide solution. Standardization is based on the description of JIS K0070-1992.

(Actual Test)

2.0 g of a crushed sample is precisely weighed in a 200-mL Erlenmeyer flask, and 100 mL of a mixed solution of toluene/ethanol (volume ratio of toluene:ethanol is 2:1) is added thereto to allow dissolution over 5 hours. Next, a few drops of the phenolphthalein solution prepared as an indicator are added, and titration is performed using the prepared potassium hydroxide solution. The titration endpoint is when the indicator continues to show faint red color for about 30 seconds.

(Blank Test)

A blank test is conducted in the same manner as the actual test except that the sample is not used (that is, only the mixed solution of toluene/ethanol (volume ratio of toluene:ethanol is 2:1) is used).

The resultant values from the titration performed in the actual test and the blank test are assigned to the following formula (1) to calculate the acid value.

$$A=[(B-C)\times f\times 5.6]/S \qquad \text{Formula (1)}$$

A: Acid value (mgKOH/g)

B: Amount (mL) of potassium hydroxide solution added in blank test

C: Amount (mL) of potassium hydroxide solution added in actual test f: Potassium hydroxide ethanol solution factor of 0.1 mol/L S: Mass (g) of sample <Measurement Method of Melting Point Tm>

The melting point (Tm) of a crystalline polyester resin is a peak top temperature of an endothermic peak and can be measured by DSC with Diamond DSC (manufactured by PerkinElmer, Inc.).

Specifically, a sample is enclosed in an aluminum pan KIT NO. B0143013, which is placed on a sample holder of the thermal analysis equipment Diamond DSC (manufactured by PerkinElmer, Inc.) and then heated, cooled, and heated in this order by changing the temperature. The temperature is raised at a temperature raising rate of 10° C./minute from a room temperature (25° C.) to 150° C. in the first stage of heating and from 0° C. to 150° C. in the second stage of heating, and the temperature is maintained at 150° C. for 5 minutes. When cooling, the temperature is dropped from 150° C. to 0° C. at a temperature lowering rate of 10° C./minute, and the temperature is maintained at 0° C. for 5 minutes. The peak top temperature of the endothermic peak in an endothermic curve obtained in the second stage of heating is measured as a melting point.

<Measurement of Number Average Long Diameter Db of Primary Particles of a Copper Phthalocyanine Compound and Calculation of Average Aspect Ratio (Db/Da)>

Each of the formers produced as above was dissolved in THF, and a THF soluble matter was removed by repeatedly performing the centrifugal separation and elimination of supernatant. After that, an insoluble matter was dispersed in THF and subjected to ultrasonic dispersion, which was then observed with an electron microscope to calculate an average aspect ratio. If the observation with the microscope is difficult to conduct due to poor solubility of a binder resin of the toner in THF or if the supernatant is colored due to dissolution of the copper phthalocyanine compound in THF, other solvents can be used.

Specifically, an image produced by the electron microscope was analyzed with an image analyzer (Luzex (registered trademark), manufactured by Nireco Corporation), and the average aspect ratio was calculated from a value of the ratio of a long side length and a short side length of a box having the smallest area among boxes that each surround a primary particle of the cyan colorant (copper phthalocyanine compound). A length of the long side is regarded as a long diameter (length of a major axis) of the primary particle, and a length of the short side is regarded as a short diameter of the primary particle. An average value was calculated from values of the ratio of the long and short sides (aspect ratio) of 500 or more primary particles in total extracted from 5 or more visual fields at random, which was determined as a value of the ratio of a number average long diameter Db to a number average short diameter Da (Db/Da).

<Presence or Absence of Peak in X-Ray Diffraction and Crystallite Size of Copper Phthalocyanine Compound Extracted from Toner>

(Method for Extracting Copper Phthalocyanine Compound (Cyan Pigment))

Each of the tonners produced as above is dissolved in tetrahydrofuran (THF), and a THF soluble matter is removed by repeatedly performing the centrifugal separation and elimination of supernatant. After that, an insoluble matter is dispersed in THF and subjected to ultrasonic dispersion (research is needed to describe an output), which is then subjected to a measurement of X-ray diffraction spectrum to analyze the peak. If the measurement of the X-ray diffraction pattern is difficult to conduct due to poor solubility of a binder resin of the toner in THF or if the supernatant is colored due to dissolution of the copper phthalocyanine compound in THF, other solvents can be used.

When the X-ray diffraction spectrum of the toner was measured using a CuKα ray as an X-ray under the following conditions, it was confirmed that the toners T1 to T6 each had a peak at a Bragg angle of 2θ=7.0±0.1° and a peak at a Bragg angle of 2θ=9.1±0.2°. Further, a study was made to confirm whether or not these toners additionally have a peak between the two peaks at the Bragg angle of 2θ=7.0±0.1° and the Bragg angle of 2θ=9.1±0.2°, and the results are shown in the table below.

An additional peak satisfying the relational expression of a/A≥0.15 where A represents a peak intensity of 2θ=7.0±0.1° and a represents a peak intensity of the peak between the two peaks was counted as the additional peak between the two peaks.

A crystallite size of a crystal assigned to the Bragg angle of 2θ=7.0±0.1° was calculated from a width of the peak (integral width) of the Bragg angle of 2θ=7.0±0.1° based on the Scherrer equation.

XRD Measurement

Device: RINT-TTR2 manufactured by Rigaku Corporation

X-ray: Cu-Kα 50 kV-300 mA (15 kW)

Optical system: Parallel beam method (transmission method)

Attachment: Capillary rotating sample table

Slit conditions: Divergent slit of 0.80 mm, scattering slit being open, and receiving slit of 1.0 mm Scan range: 2 to 45° (step width: 0.02°)

Sample preparation: Glass capillary having inner diameter of φ1 mm was filled with sample

[Evaluation Method]

<Hue Angle and Saturation>

Using a machine obtained by modifying a commercially available full-color and high-speed multifunctional printer "bizhub PRO (registered trademark) C8000 (manufactured by Konica Minolta, Inc.)" so that the printer can be set at 620 mm/sec (about 130 sheets/minute), an image (solid image patch having a size of 2 cm×2 cm) with an amount of the cyan toner adhered on the paper being 4.0 g was fixed to evaluate the color gamut in an environment at a temperature of 20° C. and a relative humidity of 50% RH.

As a transfer paper used for the evaluation, "POD gloss coated paper 128 g/m$^2$ (manufactured by Oji Paper Co., Ltd.)" was used. Further, the fixation was performed at a fixing temperature set at +10° C. from the lowest temperature of the results obtained by evaluating low-temperature fixability described below.

A useful method called "L*a*b* color system" was used to calculate the hue angle (color phase angle) and saturation. The L* axis represents brightness, the a* axis represents color phases of red to green, and the b* axis represents color phases of yellow to blue. a* and b* are measured with a spectrophotometer "Gretag Macbeth Spectrolino" (manufactured by X-Rite, Inc. (formerly GretagMacbeth GmbH)) under the conditions in which $D_{50}$ light source as a light source, a measurement wavelength range of 380 to 730 nm at 10 nm intervals, a view angle of 2°, and a UV cut filter are used and a special white tile is used to meet the standard.

The hue angle h and the saturation C* were each calculated in accordance with the following formulas for evaluation.

$$h=\tan^{-1}(b^*/a^*)$$

$$C^*=[(a^*)^2+(b^*)^2]^{1/2}$$

<Coloring Power (Image Density ID)>

After that, the image density (ID) of a solid portion of the fixed image produced as above was measured with a reflection densitometer (trade name: "X-Rite model 404" manufactured by X-Rite, Inc.) to conduct an evaluation by ranking according to 3 stages of ranks below.

(Evaluation by Ranking)

Very good: Image density of 1.25 or more

Good: Image density of 1.20 or more and less than 1.25

Poor: Image density of less than 1.20

The higher the value of the image density, the higher the coloring power (image density).

<Low-Temperature Fixability>

An evaluation of low-temperature fixability was conducted using a modified machine obtained by further modifying the machine used for evaluating the hue angle and saturation so that a temperature of a heating belt immediately after feeding a paper to a fixing nip could be measured and a linear velocity could be adjusted regardless of a basis weight of the sheet. A fixing experiment was conducted by conveying the "POD gloss coated paper 128 g/m$^2$ (manufactured by Oji Paper Co., Ltd.)" longitudinally at a paper conveying speed of 620 mm/sec in an environment at normal temperature and normal humidity (temperature of 20° C., relative humidity of 50% RH) and continuously printing on 100 sheets of paper an A4-size image in which solid strip-shaped images each having a width of 10 mm were fixed in a direction perpendicular to a conveying direction of the paper. The experiment was conducted by setting the fixing temperature to 100° C., 105° C. and so on by raising the temperature up to 210° C. at 5° C. intervals.

In the fixing experiment conducted at each fixing temperature, an evaluation of fixability was conducted on an image printed at the lowest temperature of the fixing temperature when the temperature was dropped at the start, and the lowest temperature was regarded as the fixing temperature for the temperature set in the fixing experiment. Among the images on which a stain of the image due to fixing offset was not observed, a fixing temperature which was the lowest fixing temperature of the image was regarded as the lowest fixing temperature. Regarding the amount of the toner adhered on the paper at this time, an image was fixed when the cyan toner was 10.0 g.

When the lowest fixing temperature is lower than 130° C., the toner has excellent low-temperature fixability, and when the lowest fixing temperature is 130° C. or higher and lower than 140° C., the toner can be used by controlling a fixing process and thus is acceptable. However, when the lowest fixing temperature is 140° C. or higher, the toner is not completely fixed at an intended paper conveying speed, which causes a problem in practice.

(Evaluation by Ranking)

Very good: The lowest fixing temperature of lower than 130° C.

Good: The lowest fixing temperature of 130° C. or higher and lower than 140° C.

Poor: The lowest fixing temperature of 140° C. or higher

<Amount of Copper Phthalocyanine Compound Added in Toner>

An amount of the copper phthalocyanine compound added in the toner when producing the toner was evaluated as follows.

When the amount of the copper phthalocyanine compound added is less than 3.5% by mass, the toner is excellent in terms of reducing cost and exhibits good low-temperature fixability, when the amount added is 3.5% by mass or more and less than 4.0% by mass, the toner can contribute to reduction of the cost, and when the amount added is 4.0% by mass or more, the toner can hardly contribute to reduction of the cost and the low-temperature fixability.

(Evaluation by Ranking)

Very good: Amount of copper phthalocyanine compound added in toner being less than 3.5% by mass Good: Amount of copper phthalocyanine compound added in toner being 3.5% by mass or more and less than 4.0% by mass Poor: Amount of copper phthalocyanine compound added in toner being 4.0% by mass or more

TABLE 2

| | Cyan colorant particle dispersion | | | | | Crystallite size [Å] of copper phthalocyanine | Presence or absence of peak |
|---|---|---|---|---|---|---|---|
| Toner No. | No. | Amount [mass %] of copper phthalocyanine compound added | Number average long diameter Db [nm] | Average aspect ratio (Db/Da) | Number of kinds of pigment | compound extracted from toner (2θ = 7.0 ± 0.1°) | between 2θ = 7.0 ± 0.1° and 2θ = 9.1 ± 0.2° |
| T1 | D1 | 3.3 | 102 | 4.3 | 1 kind | 183 | Present |
| T2 | D2 | 3.3 | 90 | 4.4 | 1 kind | 187 | Present |
| T3 | D3 | 3.5 | 81 | 3.6 | 1 kind | 175 | Present |
| T4 | D4 | 4.2 | 73 | 1.7 | 1 kind | 231 | Absent |
| T5 | D5 | 4.2 | 81 | 3.6 | 1 kind | 285 | Absent |
| T6 | D4 + D5 | 4.2 | 73 and 81 | 1.7 and 3.6 | 2 kinds | 247 | Absent |
| T7 | D1 + D4 | 3.6 | 102 and 73 | 4.3 and 1.7 | 2 kinds | 201 | Absent |

| | Evaluation results | | | | | |
|---|---|---|---|---|---|---|
| Toner No. | Hue angle Amount adhered 4.0 gsm | Saturation Amount adhered 4.0 gsm | Coloring power ID Amount adhered 4.0 gsm | Low-temperature fixability Amount adhered 10.0 gsm | Amount of copper phthalocyanine compound added in toner | Remarks |
| T1 | 243.5 | 60.3 | Very good | Very good | Very good | Present invention |
| T2 | 244.0 | 60.2 | Very good | Very good | Very good | Present invention |
| T3 | 243.3 | 60.2 | Good | Good | Good | Present invention |
| T4 | 241.2 | 59.0 | Poor | Poor | Poor | Comparative Example |
| T5 | 245.2 | 59.7 | Poor | Poor | Poor | Comparative Example |
| T6 | 243.1 | 59.3 | Poor | Poor | Poor | Comparative Example |
| T7 | 243.0 | 59.7 | Poor | Good | Good | Comparative Example |

From the results shown in Table II, it is found that the toner of the present invention is excellent in terms of the hue angle, the saturation, and the coloring power while reducing the amount of the pigment added in the toner and is also excellent in the low-temperature fixability, as compared to the toners in Comparative Examples.

Although embodiments of the present invention have been described and illustrated in detail, the disclosed embodiments are made for purposes of illustration and example only and not limitation. The scope of the present invention should be interpreted by terms of the appended claims The entire disclosure of Japanese Patent Application No. 2018-167722, filed on Sep. 7, 2018, is incorporated herein by reference in its entirety.

What is claimed is:

1. A toner for developing electrostatic images comprising at least a binder resin and a colorant containing a copper phthalocyanine compound, wherein in X-ray diffraction using a CuKα ray, the toner has peaks at a Bragg angle of $2\theta=7.0\pm0.1°$ and at a Bragg angle of $2\theta=9.1\pm0.2°$ and additionally has a peak between the two peaks.

2. The toner for developing electrostatic images according to claim 1, wherein a value of a ratio of a number average long diameter Db to a number average short diameter Da of primary particles of the copper phthalocyanine compound (Db/Da) is within a range of 3.0 to 6.0.

3. The toner for developing electrostatic images according to claim 1, wherein the copper phthalocyanine compound is an unsubstituted copper phthalocyanine compound.

* * * * *